US007001243B1

(12) United States Patent
Yi et al.

(10) Patent No.: US 7,001,243 B1
(45) Date of Patent: Feb. 21, 2006

(54) NEURAL NETWORK CONTROL OF CHEMICAL MECHANICAL PLANARIZATION

(75) Inventors: Jingang Yi, Albany, CA (US); Cangshan Xu, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 66 days.

(21) Appl. No.: 10/609,357

(22) Filed: Jun. 27, 2003

(51) Int. Cl.
*B24B 49/00* (2006.01)
*B24B 51/00* (2006.01)

(52) U.S. Cl. ..... 451/5; 451/8; 451/41

(58) Field of Classification Search ..... 340/680; 451/5, 8, 36, 41; 700/164
See application file for complete search history.

(56) References Cited

U.S. PATENT DOCUMENTS

| | | | | |
|---|---|---|---|---|
| 6,594,024 | B1 * | 7/2003 | Singh et al. | 356/630 |
| 6,686,270 | B1 * | 2/2004 | Subramanian et al. | 438/629 |
| 6,813,534 | B2 * | 11/2004 | Sui et al. | 700/121 |
| 2004/0076944 | A1 * | 4/2004 | Chan et al. | 434/433 |

* cited by examiner

*Primary Examiner*—Timothy V. Eley
(74) *Attorney, Agent, or Firm*—Martine Penilla & Gencarella, LLP

(57) ABSTRACT

Broadly speaking, a method for controlling a chemical mechanical planarization (CMP) process to obtain a desired result is provided. More specifically, the method incorporates a first neural network to estimate a CMP result and a second neural network to tune CMP control parameters used to obtain the CMP result. The second neural network tunes the CMP control parameters to minimize a difference between the CMP result and a desired CMP result.

14 Claims, 21 Drawing Sheets

NEURAL NETWORK CONTROL OF CHEMICAL MECHANICAL PLANARIZATION

BACKGROUND OF THE INVENTION

1. Field of the Invention

The present invention relates generally to semiconductor wafer manufacturing. More specifically, the present invention relates to control of a chemical mechanical planarization process.

2. Description of the Related Art

In the fabrication of semiconductor devices, planarization operations are often performed on a semiconductor wafer ("wafer") to provide polishing, buffing, and cleaning effects. Typically, the wafer includes integrated circuit devices in the form of multi-level structures defined on a silicon substrate. At a substrate level, transistor devices with diffusion regions are formed. In subsequent levels, interconnect metallization lines are patterned and electrically connected to the transistor devices to define a desired integrated circuit device. Patterned conductive layers are insulated from other conductive layers by a dielectric material. As more metallization levels and associated dielectric layers are formed, the need to planarize the dielectric material increases. Without planarization, fabrication of additional metallization layers becomes substantially more difficult due to increased variations in a surface topography of the wafer. In other applications, metallization line patterns are formed into the dielectric material, and then metal planarization operations are performed to remove excess metallization.

The CMP process is one method for performing wafer planarization. In general, the CMP process involves holding and contacting a rotating wafer against a moving polishing pad under a controlled pressure. CMP systems typically configure the polishing pad on a rotary table or a linear belt.

FIG. 1 is an illustration showing a linear CMP apparatus, in accordance with the prior art. The linear CMP apparatus includes a polishing pad 101 configured to rotate in a direction 105 around rollers 103. A platen 107 is disposed opposite a working surface of the polishing pad 101 to provide backing support to the polishing pad 101 during a CMP operation. A wafer carrier 109 is configured to hold and apply a wafer 111 to the working surface of the polishing pad 101 during the CMP operation. The wafer carrier 109 is capable of rotating in a direction 113 while simultaneously applying the wafer 111 to the polishing pad 101 with an appropriate force as indicated by an arrow 115. An air bearing 117 is utilized between the platen 107 and the polishing pad 101 to facilitate traversal of the polishing pad 101 across the platen 107. A slurry 119 is introduced onto and distributed over the working surface of the polishing pad 101 to facilitate and enhance the CMP operation. Additionally, a conditioner 121 is used to condition the working surface of the polishing pad 101 as it travels in the direction 105.

FIG. 2 is an illustration showing a close-up side view of the linear CMP apparatus, in accordance with the prior art. The wafer carrier 109 is shown applying the wafer 111 to the working surface of the polishing pad 101 with the appropriate force 115. As previously mentioned the polishing pad 101 travels in the direction 105 while the wafer carrier rotates in the direction 113. The slurry 119 is introduced onto the working surface of the polishing pad 101 at a location in front of the wafer carrier 109, relative to the polishing pad 101 movement direction 105. The platen 107 is shown disposed beneath the location at with the wafer 111 is applied to the polishing pad 101. The air bearing 117 is also shown between the platen 107 and the polishing pad 101. The air bearing 117 is formed by introduction of air fluids through a manifold-like structure in the platen 107. A thickness of the air bearing 117 can be changed through adjustment of a platen height. The platen height is typically measured between a top surface of the platen 107 and a fixed reference point. The air bearing 117 properties (i.e., air fluid pressures) and platen height, along with a number of other parameters, are capable of affecting an interface between the wafer 111 and the working surface of the polishing pad 101.

Much of the CMP process is empirically understood but not analytically understood. Due to a lack of analytical understanding and a lack of in situ sensors, real-time control of the CMP process is difficult. The CMP process has traditionally used a statistical surface response method (SRM) to model a relationship between CMP process parameters and associated responses. However, the SRM models are limited in their ability to provide precise, real-time response predictions for complex CMP processes performed under variable environmental conditions.

In view of the foregoing, there is a need for a method that will provide real-time response predictions for CMP processes performed under variable environmental conditions.

SUMMARY OF THE INVENTION

Broadly speaking, the present invention fills these needs by providing a method for controlling a chemical mechanical planarization (CMP) process to obtain a desired result. More specifically, the method of the present invention incorporates a first neural network to estimate a CMP result and a second neural network to tune CMP control parameters used to obtain the CMP result.

In one embodiment, a method for estimating a CMP result is disclosed. The method includes developing a neural network that is configured to relate one or more CMP control parameters to a CMP result. The method further includes training the neural network using data for the one or more CMP control parameters and the CMP result. The neural network is then used to estimate the CMP result of a subsequent CMP operation based on the one or more CMP control parameters to be applied in the subsequent CMP operation.

In another embodiment, a method for adjusting control parameters of a CMP operation is disclosed. The method includes developing a neural network that is configured to relate a comparison between a desired CMP result and an obtained CMP result to one or more CMP control parameters associated with the obtained CMP result. The method further includes training the neural network using data for the desired CMP result, the obtained CMP result, and the one or more CMP control parameters associated with the obtained CMP result. The neural network is then used to determine values for the one or more CMP control parameters to be used in a subsequent CMP operation. The values for the one or more CMP control parameters are determined by the neural network such that the obtained CMP result for the subsequent CMP operation is acceptable relative to the desired CMP result.

In another embodiment, a method for controlling a CMP process is disclosed. The method includes using a first neural network to determine settings for one or more CMP control parameters to be used in a subsequent CMP operation. The method also includes using a second neural network to estimate a CMP result for the subsequent CMP operation. The settings for the one or more CMP control parameters determined by the first neural network are used as input to the second neural network. Also in the method, the CMP result generated by the second neural network is compared to a desired CMP result to provide feedback information to the first neural network.

In another embodiment, a computer readable media containing program instructions for controlling a CMP process is disclosed. The program instructions include instructions for using a first neural network to determine settings for one or more CMP control parameters to be used in a subsequent CMP operation. The program instructions also include instructions for using a second neural network to estimate a CMP result for the subsequent CMP operation. The settings for the one or more CMP control parameters determined by the first neural network are used as input to the second neural network. Also in the program instructions, instructions are provided for comparing the CMP result generated by the second neural network to a desired CMP result to provide feedback information to the first neural network.

In another embodiment, a CMP system is disclosed. The CMP system includes a CMP apparatus for performing a CMP operation. The CMP system also includes a data acquisition system for acquiring performance data associated with the CMP operation. A neural network system of the CMP system is defined to implement a feedforward neural network and a neural network controller. The neural network system is capable of using the performance data acquired by the data acquisition system to generate control data to be supplied to the CMP apparatus. The control data can then be used for performing a subsequent CMP operation.

Other aspects and advantages of the invention will become more apparent from the following detailed description, taken in conjunction with the accompanying drawings, illustrating by way of example the present invention.

BRIEF DESCRIPTION OF THE DRAWINGS

The invention, together with further advantages thereof, may best be understood by reference to the following description taken in conjunction with the accompanying drawings in which.

DETAILED DESCRIPTION

Broadly speaking, an invention is disclosed for a method for controlling a chemical mechanical planarization (CMP) process to obtain a desired result. More specifically, the method of the present invention incorporates a first neural network to estimate a CMP result and a second neural network to tune CMP control parameters used to obtain the CMP result. In one embodiment, the CMP result estimated by the first neural network is a wafer uniformity profile. The first neural network estimates the wafer uniformity profile based on CMP control parameter inputs including one or more air bearing pressures and a platen height. In the same embodiment, the second neural network tunes the CMP control parameter inputs to minimize a difference between the estimated wafer uniformity profile and a desired wafer uniformity profile. Though the present invention is described primarily in terms of the embodiment wherein the CMP process is controlled to obtain a desired wafer uniformity profile, it should be understood that the method for controlling the CMP process using neural networks can be extended to other CMP results and associated CMP control parameters.

In the following description, numerous specific details are set forth in order to provide a thorough understanding of the present invention. It will be apparent, however, to one skilled in the art that the present invention may be practiced without some or all of these specific details. In other instances, well known process operations have not been described in detail in order not to unnecessarily obscure the present invention.

Figure 1:
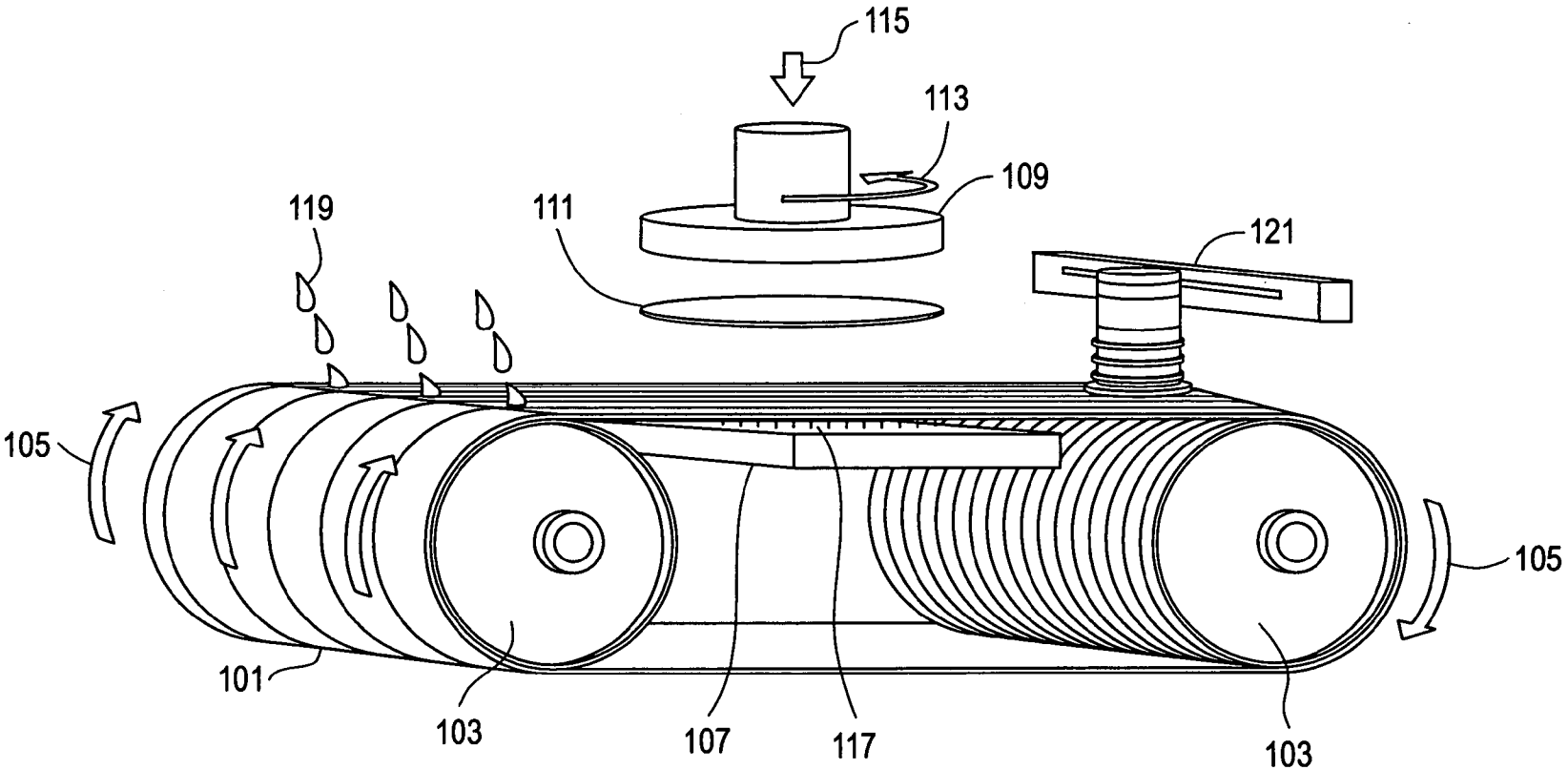
FIG. 1 (PRIOR ART)
FIG. 1 is an illustration showing a linear CMP apparatus, in accordance with the prior art.
Figure 2:
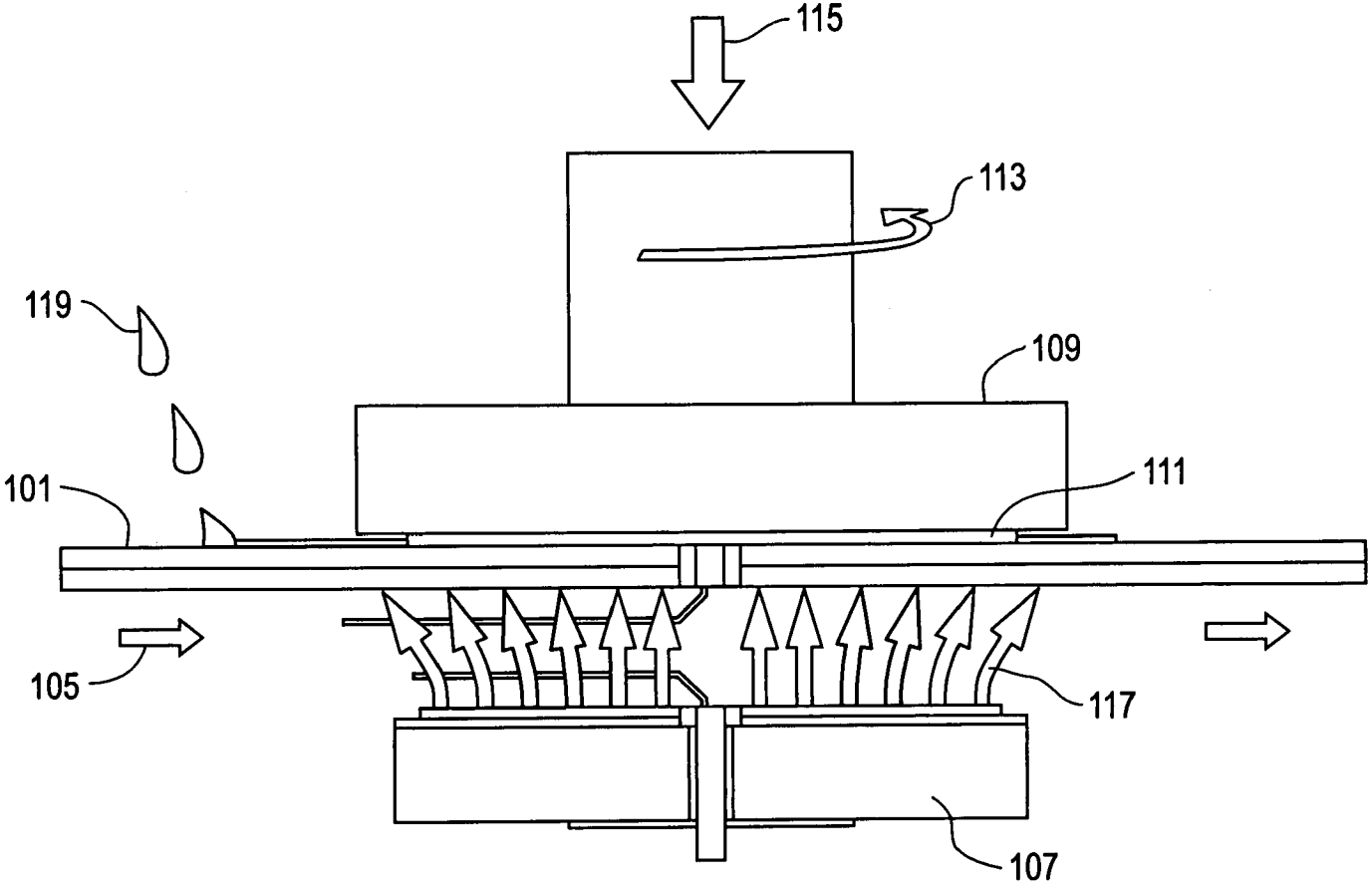
FIG. 2 (PRIOR ART)
FIG. 2 is an illustration showing a close-up side view of the linear CMP apparatus, in accordance with the prior art.
Figure 3:
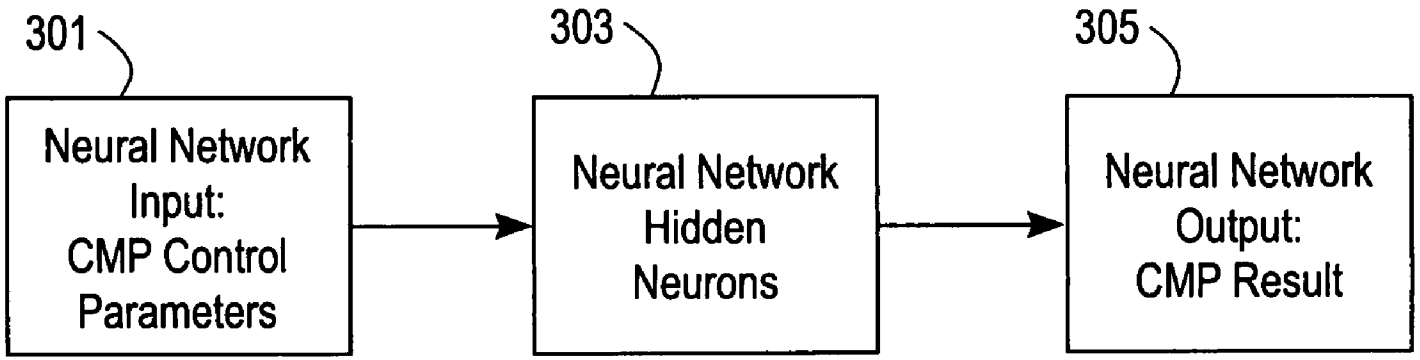
FIG. 3 is an illustration showing a generalized neural network structure used to model a relationship between a CMP result and a number of associated CMP control parameters, in accordance with one embodiment of the present invention.

FIG. 3 is an illustration showing a generalized neural network structure used to model a relationship between a CMP result and a number of associated CMP control parameters, in accordance with one embodiment of the present invention. The generalized neural network includes one or more neural network inputs 301 represented as CMP control parameters. The neural network also includes one or more hidden neurons 303 and a neural network output 305 represented as the CMP result. Each of the neural network inputs 301 are mathematically connected to each of the hidden neurons 303. Also, each of the hidden neurons 303 are mathematically connected to the neural network output 305. Using a set of known CMP control parameters and corresponding CMP result, the neural network is capable of being trained to learn relationships between the CMP control parameters (i.e., the neural network inputs 301) and the corresponding CMP result (i.e., neural network output 305). Once trained, the neural network is capable of estimating a CMP result corresponding to particular CMP control parameters. The accuracy of the estimate is generally dependent on how well the neural network is trained. A more detailed discussion of the neural network is provided below in the context of an actual neural network application to relate a wafer uniformity profile obtained from a CMP operation to CMP control parameters used in the CMP operation.

Figure 4:
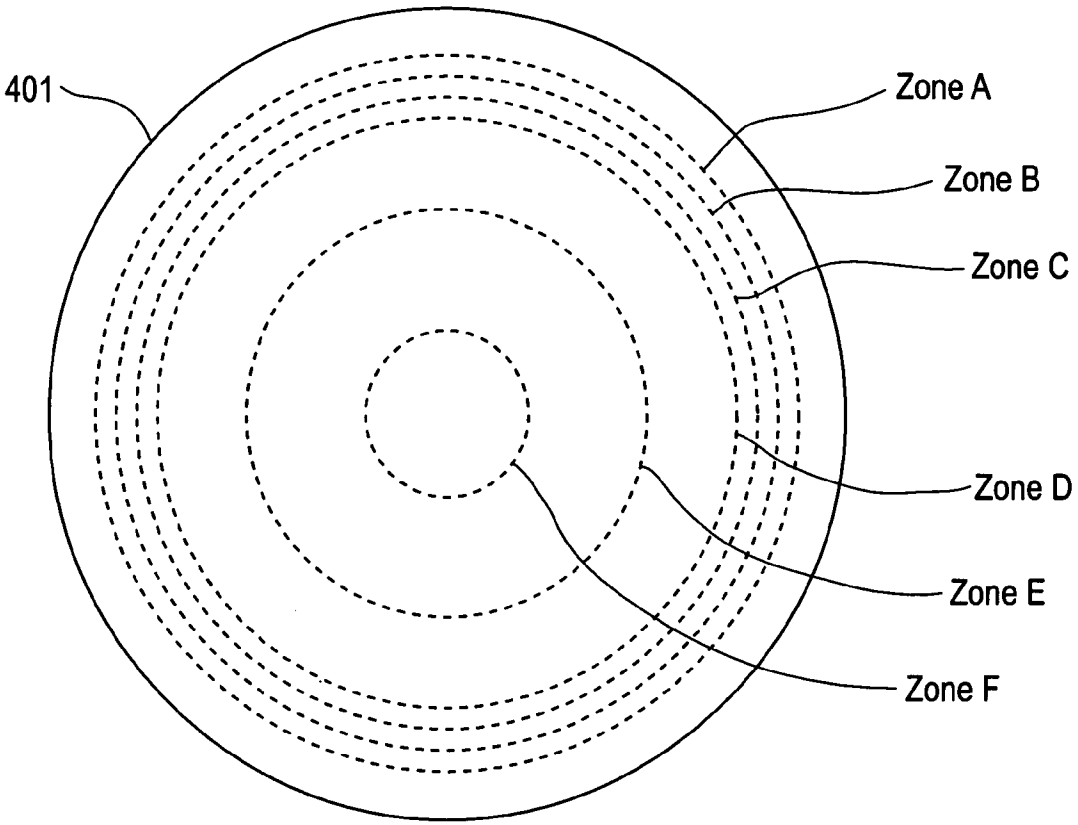
FIG. 4 is an illustration showing a top view of a platen, in accordance with one embodiment of the present invention.

It is difficult to obtain a full physical understanding and a corresponding analytical representation of the statics and dynamics that exist in a CMP polishing operation. The relationship between a wafer uniformity profile resulting from the CMP polishing operation and the control parameters used in the CMP polishing operation are considered to be non-linear. With respect to a linear CMP polishing operation, the primary control parameters affecting the uniformity profile include air bearing zone pressures and platen height. FIG. 4 is an illustration showing a top view of a platen 401, in accordance with one embodiment of the present invention. The platen 401 includes a number of concentric nozzle rings. Each nozzle ring includes a number of nozzles through which air bearing fluids are introduced during the linear CMP operation. The platen 401 and air bearing fluids provide support to an underside of a polishing pad as a wafer is applied to a working surface of the polishing pad at a location immediately opposed to the platen 401. The air bearing fluids assist the polishing pad in traversing the platen 401. Also, pressures exerted by the air bearing fluids on the polishing pad and a distance of the platen 401 from the polishing pad (i.e., platen height) affect the uniformity profile resulting from the linear CMP operation. With reference to FIG. 4, each of the concentric nozzle rings represents a different air bearing pressure zone. From outside to inside, the air bearing pressure zones are labeled as Zone A, Zone B, Zone C, Zone D, Zone E, and Zone F. In the present embodiment, the control parameters considered relevant to estimating the resulting wafer uniformity profile include the pressure of Zone B ($P_b$), the pressure of Zone C ($P_c$), the pressure of Zone D ($P_d$), the pressure of Zone E ($P_e$), and the platen height (PH). In other embodiments, different control parameters can be considered relevant to estimating the resulting wafer uniformity profile. Additionally, in other embodiments, the neural network method of the present invention can be applied to estimating other CMP process results based on corresponding sets of control parameters.

In the linear CMP process, the wafer processing time is long relative to the aerodynamics of the air bearing. Therefore, it is appropriate to consider that a static relationship exists between the control parameters ($P_b$, $P_c$, $P_d$, $P_e$, PH) and the linear CMP process result (uniformity profile). In following, it is appropriate to apply a static neural network model to describe the relationship between the control parameters and the linear CMP process result.

Figure 5:
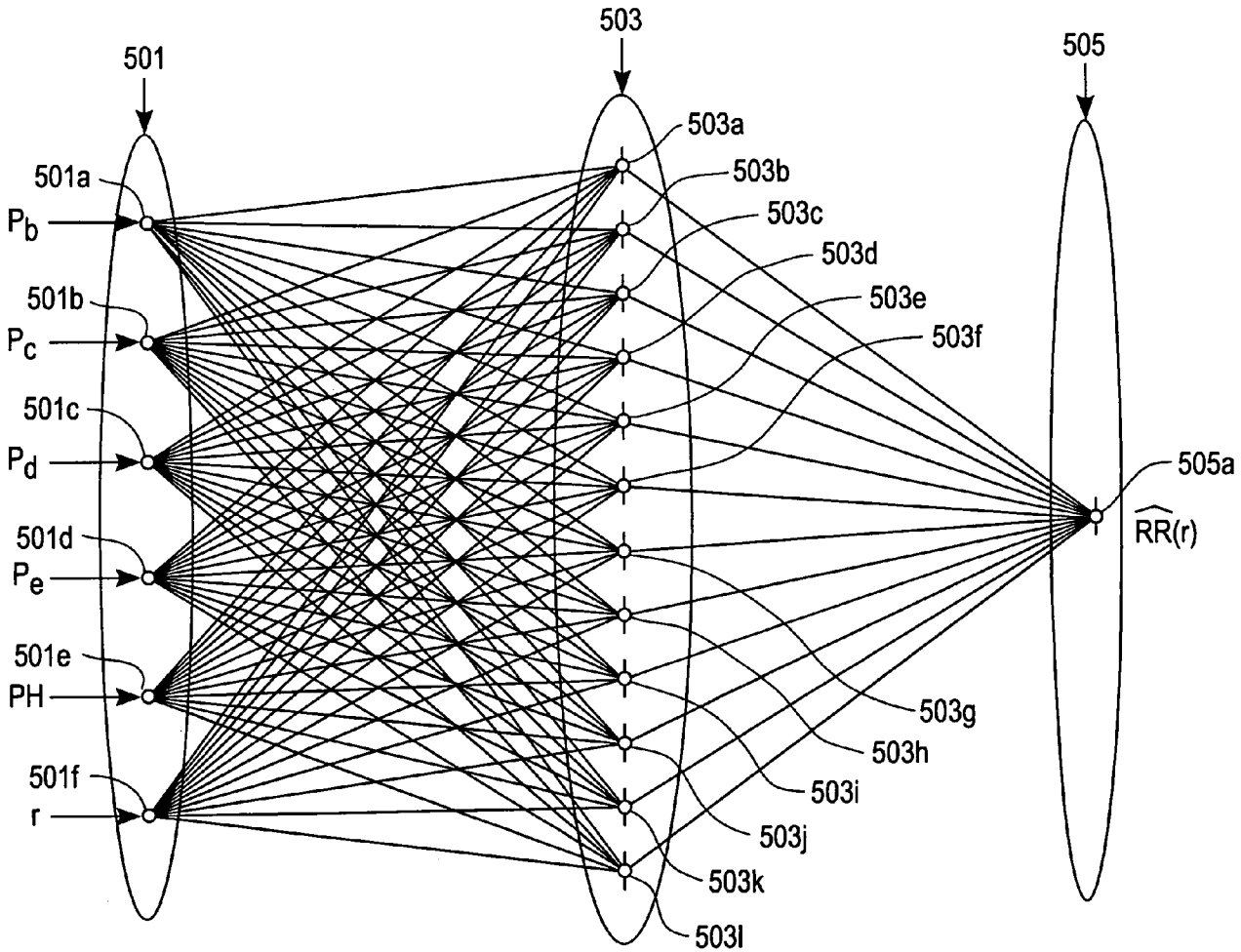
FIG. 5 is an illustration showing an architecture of a static neural network model used to describe the relationship between the control parameters and the linear CMP process result, in accordance with one embodiment of the present invention.

FIG. 5 is an illustration showing an architecture of a static neural network model used to describe the relationship between the control parameters and the linear CMP process result, in accordance with one embodiment of the present invention. The static neural network model of FIG. 5 is also referred to as a feedforward neural network. As inputs, the feedforward neural network accepts the control parameters $P_b$, $P_c$, $P_d$, $P_e$, and PH. The feedforward neural network also expresses the estimated wafer uniformity profile as an estimated material removal rate $\overline{RR}(r)$ at a radial position (r) across the wafer. Correspondingly, the feedforward neural network also accepts the radial position (r) as an input. The radial position (r) is measured from the center of the wafer.

The feedforward neural network includes an input layer 501, one hidden layer 503, and an output layer 505. The input layer 501 includes one neuron for each input accepted by the feedforward neural network. Inputs $P_b$, $P_c$, $P_d$, $P_e$, PH, and r are received by neurons 501*a*–501*f*, respectively. The feedforward neural network includes one hidden layer 503 because a multi-level neural network having one hidden layer is a good approximation for many nonlinear functions. A number of neurons in the hidden layer 503 is dependent on the training process used with the feedforward neural network. The hidden layer 503 of the present embodiment incorporates twelve neurons (503*a*–503*l*). Each neuron (501*a*–501*f*) of the input layer 501 is mathematically connected to each neuron (503*a*–503*l*) of the hidden layer 503. The output layer 505 includes one neuron 505*a* that represents the estimated material removal rate $\overline{RR}(r)$. Each neuron (503*a*–503*l*) of the hidden layer 503 is mathematically connected to the neuron 505*a* of the output layer 505.

The feedforward neural network of the present embodiment can be expressed as shown in Equation 1. With respect to Equation 1, $\overline{RR}(r)$ is the estimated material removal rate at position (r) and $F(P_b, P_c, P_d, P_e, PH, r)$ is an arbitrary function of the control parameters and radius. The control parameters are also represented as input layer $u=[P_b,P_c,P_d,P_e,PH]^T$.

$$\overline{RR}(r)=F(P_b,P_c,P_d,P_e,PH,r)=F(u,r) \quad \text{Equation 1:}$$

An activation function is used to represent each neuron (503*a*–503*l*) of the hidden layer 503. In different embodiments, the activation function can be either a linear or hyperbolic tangent (tanh) or logistic sigmoid function. The present embodiment uses the hyperbolic tangent (tanh) function as the activation function for each neuron (503*a*–503*l*). Also in the present embodiment, a linear function is used to represent the neuron 505*a* of the output layer 505. Using the linear function for the neuron 505*a* allows the feedforward neural network output to have an unlimited range.

Equation 2 is a further representation of Equation 1 incorporating the feedforward neural network functionality. With respect to Equation 2, a set of input-to-hidden layer weights is represented as $w_{ji}$ and a set of hidden-to-output layer weights is represented as $W_j$, for j=0,1, . . . , $M_2$ and i=0,1, . . . , $M_1$, where $M_1$ and $M_2$ are the number of inputs to and the number of hidden neurons of, respectively, the feedforward neural network. Also with respect to Equation 2, $\Theta_{ff}=(W_j\ w_{ji})$ is a vector in $R^{px1}$, $p=(M_1+2)M_2+1$, that combines hidden-to-output layer and input-to-hidden layer weights of the feedforward neural network. Also, $\Phi=(\phi_i)=[P_b,P_c,P_d,P_e,PH,r]^T$.

Equation 2:

$$\overline{RR}(r)=\sum_{j=1}^{M_2} W_j \tanh\left(\sum_{i=1}^{M_1} w_{ji}\varphi_i + w_{j0}\right) + W_0 = f(\Phi,\Theta_{ff})$$

After defining the feedforward neural network, it is necessary to train the weights of the feedforward neural network. The weights are trained by selecting a proper data set $\{P_b^k, P_c^k, P_d^k, P_e^k, PH^k, r_i^k, RR^k(r_i), k=1, \ldots, N, i=1, \ldots, M\}$, where k represents the $k^{th}$ CMP polishing operation, N represents the total number of CMP polishing operations for training, and M represents the number of measurement points across the wafer diameter. The measurements are used to determine the actual material removal rate $RR_k(r_i)$. In one embodiment, the wafer thickness after the CMP operation can be measured and compared to a known wafer thickness prior to the CMP operation to determine the actual material removal rate. The material removal rate across the wafer surface can be directly correlated to the wafer uniformity profile. In order for the weights to be properly trained, the values of $P_b$, $P_c$, $P_d$, $P_e$, and PH in the data set should be chosen properly. Since the relationship between the control parameters and the linear CMP process result is non-linear, values of the training data set should vary for different operational conditions. Furthermore, values of the control parameters in the training data set should be selected to cover the expected operating range of each control parameter. The feedforward neural network will provide more accurate estimates of the material removal rate when the control parameter inputs are within the ranges of the training data set. In one embodiment, the data from a design of experiments (DOE) used during qualification and tuning of the linear CMP apparatus can be used as the training data set.

Recalling that the hyperbolic tangent was used as the activation function, the control parameter inputs can be scaled to avoid saturation of the activation function. For example, in one embodiment the air bearing pressure for each zone is scaled to the maximum air bearing pressure for the corresponding zone (i.e., $P_{i\ s}=(P_i/P_{i\ max})$, i=b, c, d, e). Also, the platen height is scaled to the maximum platen height (i.e., $PH_s=PH/PH_{max}$). Also, the removal rate is scaled to the maximum removal rate (i.e., $RR_s=RR/RR_{max}$). Also, the radial position is scaled to the maximum radial position (i.e., $r_s=r/r_{max}$). In one embodiment, $P_{b\ max}$=30 psi, $P_{c\ max}$=45 psi, $P_{d\ max}$=70 Psi, $P_{e\ max}$=30 psi, $PH_{max}$=40 mil, $RR_{max}$=7000 Å/min, and $r_{max}$=100 mm.

Calculation of the weights $\Theta_{ff}^k$ of the feedforward neural network at the $k^{th}$ CMP polishing operation is performed by iteratively (i.e., from CMP polishing operation-to-CMP polishing operation) minimizing an estimation error function $E_1^k(\Theta_{ff}^k)$ as shown in Equation 3.

Equation 3:

$$E_1^k(\Theta_{ff}^k)=\frac{1}{2}\sum_{i=1}^{M}\left(RR^k(r_i)-\overline{RR}^k(r_i)\right)^2 = \frac{1}{2}\sum_{i=1}^{M}\left(RR^k(r_i)-f(\Phi^k(r_i),\Theta_{ff}^k)\right)^2=\frac{1}{2}\|\varepsilon^k\|^2$$

With respect to Equation 3, $\epsilon_i^k=RR^k(r_i)-\overline{RR}^k(r_i)$ is the estimate error evaluated at $r_i$ at the $k^{th}$ CMP polishing operation and $\epsilon^k\in R^M$ is a vector with elements $\epsilon_i^k$, $1\leqq k\leqq N$ and $1\leqq i\leqq M$. Prior to training, initial weights $\Theta_{ff}(0)$ of the feedforward neural network are randomly selected from the range extending from −0.5 to +0.5. Using a first order Taylor expansion of $f(\Phi^k(r_i), \Theta_{ff}^k)$ around the initial values of $\Theta_{ff}^k$, the expression of Equation 4 is obtained.

$$f(\Phi^k(r_i),\Theta_{ff}^k+\Delta\Theta_{ff}^k)\approx f(\Phi^k(r_i),\Theta_{ff}^k)+J\Delta\Theta_{ff}^k,\quad \text{for small } \Delta\Theta_{ff}^k \qquad \text{Equation 4:}$$

With respect to Equation 4, $J\in R^{Mxp}$ is the Jacobian matrix $$\frac{\partial f(\Phi^k(r_i),\Theta_{ff}^k)}{\partial\Theta_{ff}^k}.$$

Thus, $E_1(\Theta_{ff}^k+\Delta\Theta_{ff}^k)$ can be represented as shown in Equation 5.

$$E_1(\Theta_{ff}^k+\Delta\Theta_{ff}^k)\approx E_1(\Theta_{ff}^k)+G^T\Delta\Theta_{ff}^k\tfrac{1}{2}\Delta\Theta_{ff}^{k\,T}J^TJ\Delta\Theta_{ff}^k \qquad \text{Equation 5:}$$

With respect to Equation 5, $G=\nabla E_1(\Theta_{ff}^k)=J^T\epsilon^k$. If $$\frac{\partial E_1(\Theta_{ff}^k+\Delta\Theta_{ff}^k)}{\partial\Delta\Theta_{ff}^k}=0,$$

then $\Delta\Theta_{ff}^k$ can be expressed as shown in Equation 6.

$$\Delta\Theta_{ff}^k=-(J^TJ)^{-1}J^T\epsilon^k \qquad \text{Equation 6:}$$

Equation 6 is know as the Gauss-Newton algorithm. In one embodiment, Equation 6 can be applied iteratively from CMP polishing operation-to-CMP polishing operation to minimize the estimate error function. However, the step size given by Equation 6 could be sufficiently large to invalidate the linear approximation used in Equation 4. Therefore, in another embodiment, a modified estimation error function, based on the Levenberg-Marquardt algorithm, can be used to ensure that the linear approximation used in Equation 4 remains valid. The modified estimation error function is shown in Equation 7.

$$E_1(\Theta_{ff}^k+\Delta\Theta_{ff}^k)\approx E_1(\Theta_{ff}^k)+G^T\Delta\Theta_{ff}^k+\tfrac{1}{2}\Delta\Theta_{ff}^{k\,T}J^TJ\Delta\Theta_{ff}^k+\tfrac{1}{2}\lambda\|\Delta\Theta_{ff}^k\|^2 \qquad \text{Equation 7:}$$

In Equation 7, the parameter λ governs the step size. Through the use of Equation 7, the estimation error function can be minimized while simultaneously keeping the step size sufficiently small so as to ensure that the linear approximation of Equation 4 remains valid. With respect to Equation 7, if $$\frac{\partial E_1(\Theta_{ff}^k + \Delta\Theta_{ff}^k)}{\partial \Delta\Theta_{ff}^k} = 0,$$

then $\Delta\Theta_{ff}^k$ can be expressed as shown in Equation 8.

$$\Delta\Theta_{ff}^k = -(J^T J + \lambda I)^{-1} J^T \epsilon^k \quad \text{Equation 8:}$$

The expression for $\Delta\Theta_{ff}^k$, as shown in Equation 8, is called an adaptation of neural network weights. In the present embodiment, Equation 8 represents the adaptation of the feedforward neural network weights. Equation 8 can be applied iteratively from CMP polishing operation-to-CMP polishing operation to minimize the estimate error function. Thus, during training Equation 8 can be applied iteratively with the set of training data to train the weights of the feedforward neural network. Also, Equation 8 can be applied to update the weights of the feedforward neural network after each complete (all M measurement points across the wafer diameter) set of new measurement data is obtained. Once developed and trained, the feedforward neural network can be used to estimate the CMP result of a subsequent CMP operation based on the one or more CMP control parameters to be applied in the subsequent CMP operation.

CMP processes are generally performed to achieve a desired wafer condition (e.g., uniformity profile). The feedforward neural network previously described can be used to estimate a CMP result corresponding to a given set of CMP control parameters. If the CMP result estimated by the feedforward neural network is within an acceptable range of the desired wafer condition, values for the corresponding set of CMP control parameters can be considered acceptable. However, if the CMP result estimated by the feedforward neural network is not within an acceptable range of the desired wafer condition, values for the corresponding set of CMP control parameters will need to be adjusted. Since the exact relationship between a particular CMP control parameter and both the other CMP control parameters and the CMP result is complex and not precisely known, determining how to adjust one or more of the CMP control parameters to obtain the desired wafer condition can be difficult. To solve this difficulty, the present invention employs a neural network based controller for adjusting the CMP control parameters to obtain a desired CMP result.

Figure 6:
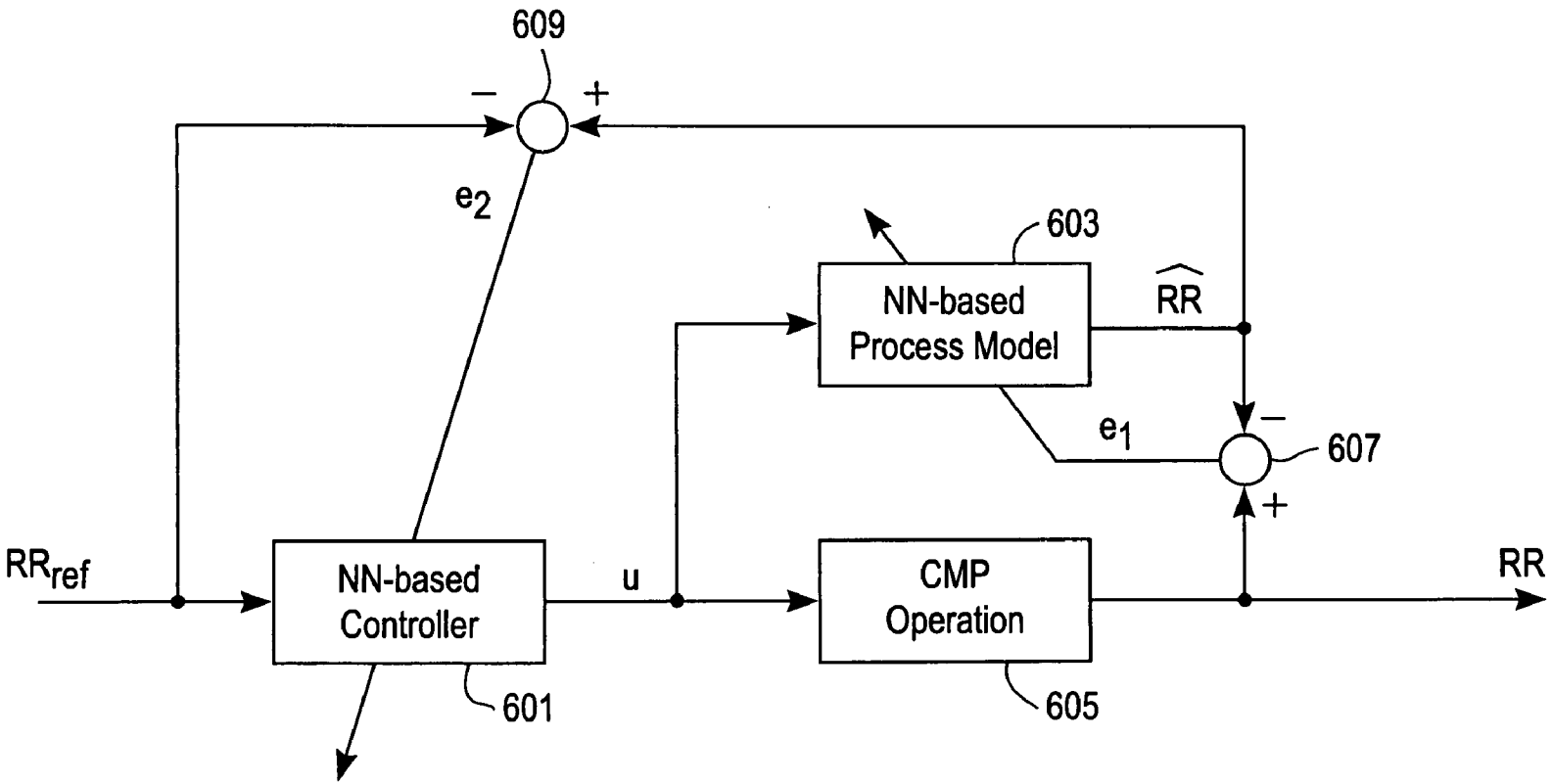
FIG. 6 is an illustration showing a neural network based CMP control system, in accordance with one embodiment of the present invention.

FIG. 6 is an illustration showing a neural network based CMP control system, in accordance with one embodiment of the present invention. The neural network based CMP control system ("NN control system") is shown to include a neural network controller 601 and a neural network process model 603. The neural network process model 603 is equivalent to the feedforward neural network model previously discussed. As such, the neural network process model 603 accepts as input the control parameters of the input layer ($u=[P_b,P_c,P_d,P_e,PH]$). As an output, the neural network process model 603 provides the estimated material removal rate $\overline{RR}(r)$. The neural network controller 601 accepts a reference material removal rate $RR_{ref}$ as an input. The reference material removal rate $RR_{ref}$ corresponds to a desired wafer condition (e.g., uniformity profile). The neural network controller 601 provides values for the control parameters of the input layer (u) as output. The control parameters are used as input to both the neural network process model 603 and the actual CMP operation 605.

A difference $e_2$ between the estimated material removal rate $\overline{RR}(r)$ and the reference material removal rate $RR(r)_{ref}$ is determined at item 609. The neural network controller 601 accepts the difference $e_2$ from item 609 and adjusts the control parameters to minimize the difference $e_2$.

A difference $e_1$ between the estimated material removal rate $\overline{RR}(r)$ and the actual material removal rate RR(r) is determined at item 607. The difference $e_1$ is analogous to the estimate error previously discussed with respect to Equation 3. Thus, the neural network process model 603 uses the difference $e_1$ to update the weights of the feedforward neural network after each new complete set of actual material removal rate RR(r) measurement data is obtained.

The neural network based control system of FIG. 6 employs a direct inverse control strategy. The process to be controlled should be invertible (such as the CMP process) to apply the direct inverse control strategy. The goal of the neural network based control system is to regulate the output of the CMP operation (RR(r)) to most closely match the input $RR(r)_{ref}$, from one CMP operation to another CMP operation.

Figure 7:
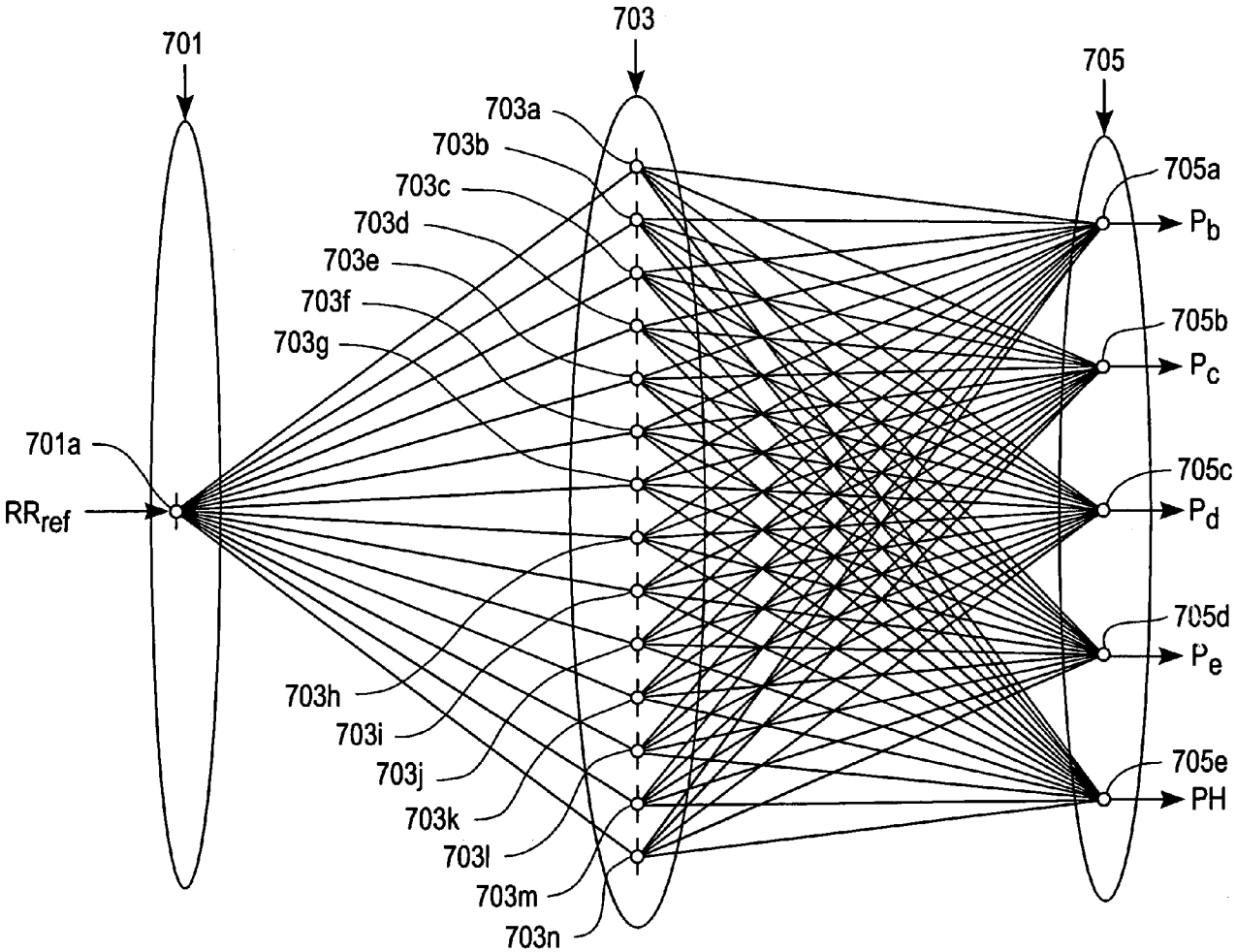
FIG. 7 is an illustration showing an architecture of a neural network controller, in accordance with one embodiment of the present invention.

FIG. 7 is an illustration showing an architecture of a neural network controller, in accordance with one embodiment of the present invention. The neural network controller includes an input layer 701, one hidden layer 703, and an output layer 705. The input layer 701 includes one neuron 701*a* for receiving the reference material removal rate $RR(r)_{ref}$ as an input. The neural network controller includes one hidden layer 703 because a multi-level neural network having one hidden layer is a good approximation for many nonlinear functions. A number of neurons in the hidden layer 703 is dependent on the training process used with the feedforward neural network. The hidden layer 703 of the present embodiment incorporates fourteen neurons (703*a*–703*n*). The neuron (701*a*) of the input layer 701 is mathematically connected to each neuron (703*a*–703*n*) of the hidden layer 703. The output layer 705 includes one neuron for each of the CMP control parameters. Accordingly, neurons 705*a*–705*e* provide the CMP control parameters $P_b$, $P_c$, $P_d$, $P_e$, and PH, respectively. Each neuron (703*a*–703*n*) of the hidden layer 703 is mathematically connected to each neuron (705*a*–705*e*) of the output layer 705.

Training the weights of the neural network controller can be performed in a similar manner to that used with the feedforward neural network. The neural network controller is capable of tuning the CMP control parameters to drive the actual material removal rate RR(r) to the desired reference material removal rate $RR(r)_{ref}$. The estimated material removal rate $\overline{RR}(r)$ obtained from the feedforward neural network is used as feedback to train and update the weights of the neural network controller. Thus, $\overline{RR}(r)$ is used to construct an adaptation law for the weights of the neural network controller, $\Theta_{inv} \in R^{qx1}$, $q=(M_1+2)M_3+1$, where $M_1$ is the number of output layer neurons and $M_3$ is the number of hidden layer neurons.

The neural network controller is trained simultaneously with the feedforward neural network as previously described. A recursive error back-propagation (BP) method is used to train the weights of the neural network controller at each CMP operation used in the training of the feedforward neural network. In training the weights of the neural network controller, an error at a $k^{th}$ CMP operation, as expressed by Equation 9, is minimized.

Equation 9:

$$E_2^k(\Theta_{inv}^k) = \frac{1}{2}\sum_{i=1}^{M}\left[RR_{ref}^k(r_i) - \overline{RR}^k(r_i)\right]^2$$

With respect to Equation 9, $\overline{RR}^k(r_i)$ is the estimate of $RR^k(r_i)$ obtained by updating the feedforward neural network weights using the measurement data from the $k_{th}$ CMP operation. It is assumed that the estimated material removal rate $\overline{RR}^k(r_i)$ is approximately equal to the real removal rate $RR_k(r_i)$ at the $k^{th}$ CMP operation. The effectiveness of this assumption is guaranteed by the accuracy of the feedforward neural network.

The adaptation laws of weights $\Theta_{inv}{}^k$ for the neural network controller are obtained following a similar method as previously described with respect to the adaptation laws of weights of the feedforward neural network. Since the weights of the neural network controller can only affect the actual material removal rate $RR^k(r)$ through the CMP control parameters, the error gradient can be computed using the chain rule as shown in Equation 10.

Equation 10:

$$\frac{\partial E_2^k}{\partial \Theta_{inv}^k} = \sum_{i=1}^{M}\frac{\partial E_2^k}{\partial \overline{RR}^k}\cdot\frac{\partial \overline{RR}^k}{\partial u^k}\cdot\frac{\partial u^k}{\partial \Theta_{inv}^k}$$

With respect to Equation 10, the first partial derivative can be calculated using Equation 9 as $(\overline{RR}^k(r_i)-RR_{ref}{}^k(r_i))$. The third partial derivative can be calculated using a standard BP algorithm. To calculate the second term of Equation 10, it is necessary to recall the feedforward neural network architecture.

Figure 8:
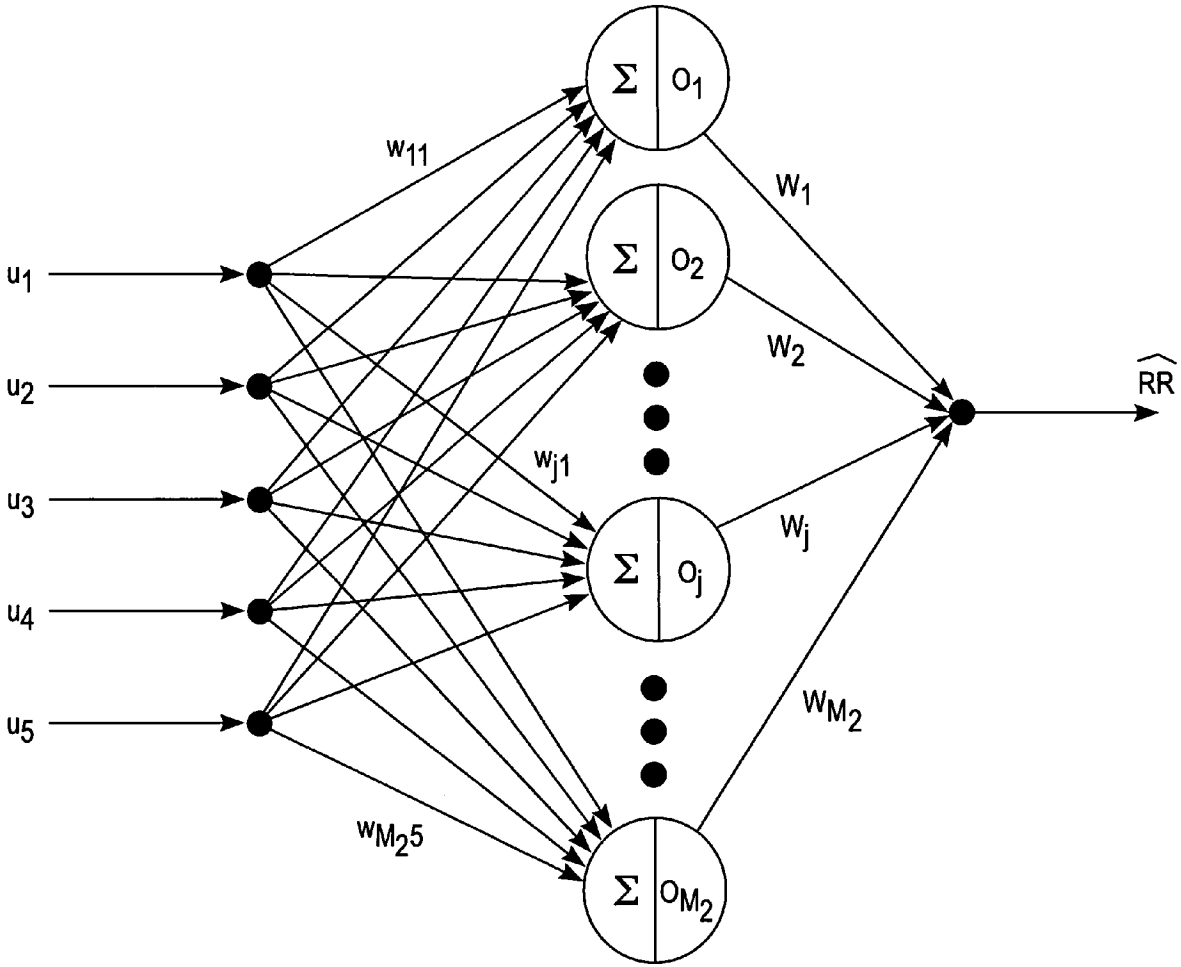
FIG. 8 is an illustration showing a portion of the architecture of the feedforward neural network, in accordance with one embodiment of the present invention.

FIG. 8 is an illustration showing a portion of the architecture of the feedforward neural network, in accordance with one embodiment of the present invention. The input layer neurons are denoted by $u_1$, $u_2$, $u_3$, $u_4$, and $u_5$, and correspond to the CMP control parameters $P_b$, $P_c$, $P_d$, $P_e$, and PH, respectively. The output layer neuron corresponds to the estimated material removal rate $\overline{RR}(r)$. A particular radius $r_i$ is needed as an additional input in order to use the feedforward neural network to obtain the estimated material removal rate $\overline{RR}(r_i)$, i=1, . . . , M. With respect to FIG. 8, the output of each of the hidden layer neurons are denoted by $O_1$, . . . , $O_j$, . . . , $O_{M2}$. The weights between the input-to-hidden layers and the hidden-to-output layers are denoted as $w_{ji}$ and $W_j$, respectively, where i=1, . . . , 5, and j=1, . . . , $M_2$. Through examination of the portion of the architecture of the feedforward neural network shown in FIG. 8, it is possible to derive the second term in Equation 10 for each CMP operation. In following, the second term in Equation 10 can be expressed as shown in Equation 11.

Equation 11:

$$\frac{\partial \overline{RR}^k}{\partial u_i^k} = \sum_{j=1}^{M_2}\frac{\partial \overline{RR}^k}{\partial O_j^k}\cdot\frac{\partial O_j^k}{\partial u_i^k} \quad \text{where}$$

$$\frac{\partial \overline{RR}^k}{\partial O_j^k} = W_j,\ \frac{\partial O_j^k}{\partial u_i^k} = (1 - O_j^{k\,2})w_{ji},\ i = 1, \ldots, 5,\ j = 1, \ldots, M_2$$

In one embodiment, a learning rate of the BP algorithm used in training the neural network controller is set at $\Theta=10^{-5}$. However, in other embodiments, other learning rates can be applied. Also, in one embodiment, a smoothing filter having a momentum $\alpha=0.1$ is used to speed parameter convergence. In accordance with the foregoing, Equation 12 shows an adaptation of neural network weights as applied to the neural network controller of the present invention.

$$\Delta\Theta_{inv_{new}}{}^k = \Delta\Theta_{inv}{}^k \alpha \Delta\Theta_{inv_{new}}{}^{k-1} \qquad \text{Equation 12:}$$

Equation 12 can be applied iteratively from CMP polishing operation-to-CMP polishing operation to minimize the error as shown in Equation 9. Thus, during training of the feedforward neural network, Equation 12 can be applied to train the weights of the neural network controller. Also, Equation 12 can be applied to update the weights of the neural network controller after each complete (all M measurement points across the wafer diameter) set of new measurement data is obtained. Once developed and trained, the neural network controller can be used in combination with the feedforward neural network to regulate the CMP operation to produce a CMP result that most closely matches a desired CMP result. In other words, the neural network controller can be used to determine values for the one or more CMP control parameters to be used in a subsequent CMP operation such that the obtained CMP result for the subsequent CMP operation is acceptable relative to the desired CMP result.

Figure 9:
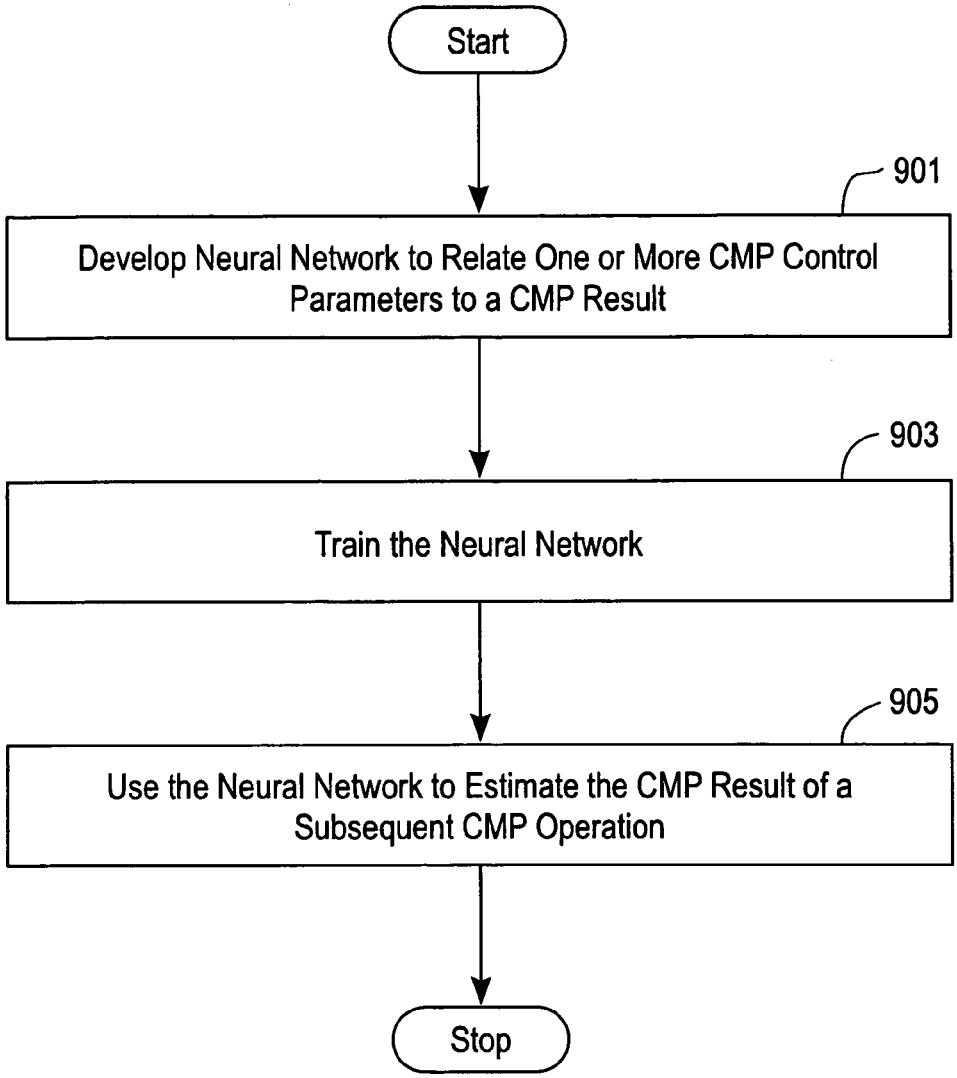
FIG. 9 is an illustration showing a flowchart of a method for estimating a CMP result, in accordance with one embodiment of the present invention.

FIG. 9 is an illustration showing a flowchart of a method for estimating a CMP result, in accordance with one embodiment of the present invention. The method includes an operation 901 in which a neural network is developed to relate one or more CMP control parameters to a CMP result. The feedforward neural network previously discussed is an example of the neural network referred to in operation 901. As such, the neural network is a static neural network having an input layer, one hidden layer, and an output layer. The one hidden layer includes a number of hidden neurons, and the output layer includes one output neuron. Each of the hidden neurons has a hyperbolic tangent activation function, and the output neuron is represented by a linear function. In one embodiment, the CMP result is a wafer uniformity profile obtained using a linear CMP apparatus. In the same embodiment, the one or more CMP control parameters can include an air bearing pressure and a platen height.

The method further includes an operation 903 in which the neural network of operation 901 is trained. Training of the neural network is performed using data for the one or more CMP control parameters and associated CMP result. In one embodiment, the method further includes selecting the training data from a design of experiments used to qualify the CMP apparatus used to obtain the CMP result. The training data is selected to cover an anticipated range for the one or more CMP control parameters and the CMP result. In one embodiment, the training of operation 901 is based on an iterative minimization of an estimation error function performed using an adaptation of weights of the neural network, wherein the adaptation of weights of the neural network is based on a Levenberg-Marquardt algorithm.

The method also includes an operation 905 in which the trained neural network is used to estimate the CMP result of a subsequent CMP operation based on the one or more CMP control parameters to be applied in the subsequent CMP operation. In one embodiment, the method further includes updating the weights of the neural network using the one or more CMP control parameters applied in the subsequent CMP operation and the CMP result of the subsequent CMP operation.

Figure 10:
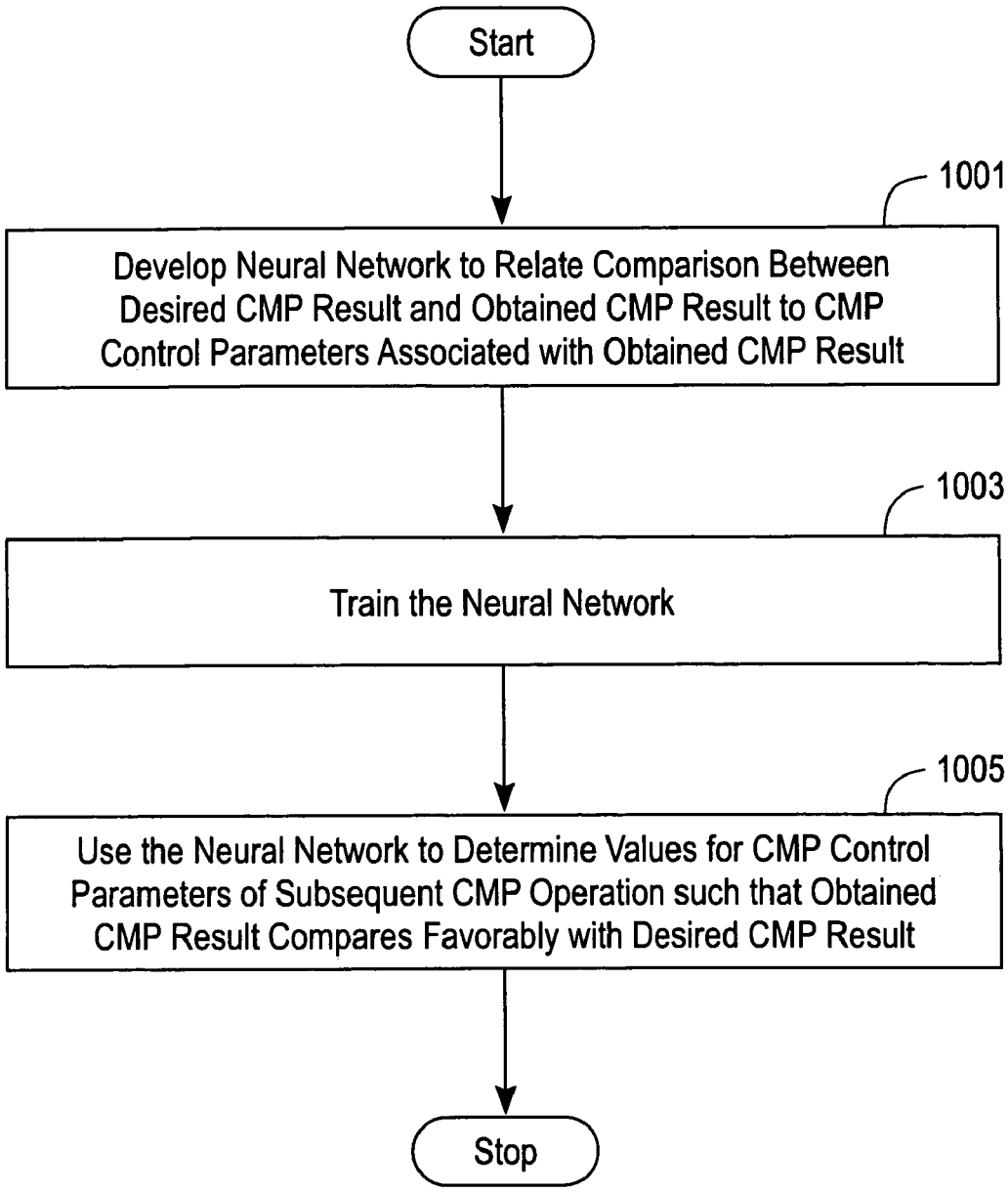
FIG. 10 is an illustration showing a flowchart of a method for adjusting CMP control parameters, in accordance with one embodiment of the present invention.

FIG. 10 is an illustration showing a flowchart of a method for adjusting CMP control parameters, in accordance with one embodiment of the present invention. The method includes an operation 1001 in which a neural network is developed to relate a comparison between a desired CMP result and an obtained CMP result to one or more CMP control parameters associated with the obtained CMP result. The neural network controller previously discussed is an example of the neural network referred to in operation 1001. As such, the neural network is a static neural network having an input layer, one hidden layer, and an output layer. The input layer includes the desired CMP result. The one hidden layer includes a number of hidden neurons. The output layer includes an output for each of the one or more CMP control parameters. In one embodiment, the CMP result is a wafer uniformity profile obtained using a linear CMP apparatus. In the same embodiment, the one or more CMP control parameters can include an air bearing pressure and a platen height.

The method further includes an operation 1003 in which the neural network of operation 1001 is trained using data for the desired CMP result, the obtained CMP result, and the one or more CMP control parameters associated with the obtained CMP result. In one embodiment, the data used for training the neural network includes as estimation of the obtained CMP result generated using a second neural network to model the CMP operation. Also, in one embodiment, training of the neural network is performed using a recursive error back propagation method.

The method also includes an operation 1005 in which the trained neural network is used to determine values for the one or more CMP control parameters to be used in a subsequent CMP operation. The values of the one or more CMP control parameters are determined such that the obtained CMP result of the subsequent CMP operation is acceptable relative to the desired CMP result.

Figure 11:
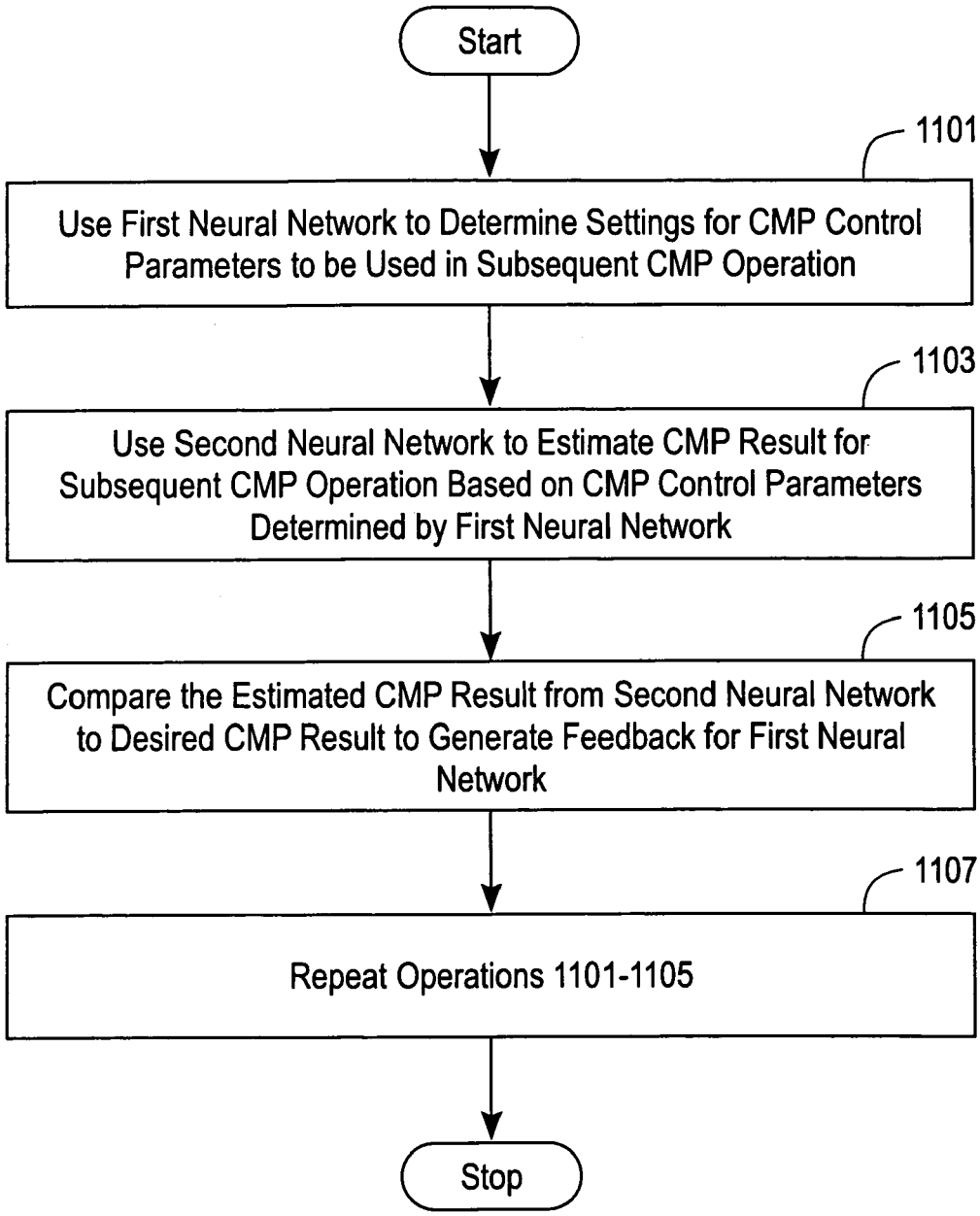
FIG. 11 is an illustration showing a flowchart of a method for controlling a CMP process, in accordance with one embodiment of the present invention.

FIG. 11 is an illustration showing a flowchart of a method for controlling a CMP process, in accordance with one embodiment of the present invention. The method includes an operation 1101 in which a first neural network is used to determine settings for one or more CMP control parameters to be used in a subsequent CMP operation. The neural network controller previously discussed is an example of the first neural network referred to in operation 1101. As such, the first neural network is a static neural network having an input layer, one hidden layer, and an output layer. The input layer includes the desired CMP result. The one hidden layer includes a number of hidden neurons. The output layer includes an output for each of the one or more CMP control parameters. In one embodiment, the CMP result is a wafer uniformity profile obtained using a linear CMP apparatus. In the same embodiment, the one or more CMP control parameters can include an air bearing pressure and a platen height.

The method also includes an operation 1103 in which a second neural network is used to estimate a CMP result for the subsequent CMP operation, wherein the subsequent CMP operation is performed using settings for the one or more CMP control parameters as determined by the first neural network in operation 1101. The feedforward neural network previously discussed is an example of the second neural network referred to in operation 1103. As such, the second neural network is a static neural network having an input layer, one hidden layer, and an output layer. The one hidden layer includes a number of hidden neurons, and the output layer includes one output neuron. Each of the hidden neurons has a hyperbolic tangent activation function, and the output neuron is represented by a linear function.

In one embodiment, the first neural network is trained using data for the desired CMP result, an actual CMP result, and the one or more CMP control parameters associated with the actual CMP result. In another embodiment, the CMP result generated by the second neural network in a previous CMP operation is used in lieu of the actual CMP result.

In one embodiment, the second neural network is trained using data for the one or more CMP control parameters and the actual CMP result corresponding to the one or more CMP control parameters. In an associated embodiment, the data used for training the second neural network can be selected from a design of experiments used to qualify a CMP apparatus used to produce the actual CMP result.

The method further includes an operation 1105 in which the CMP result generated by the second neural network is compared to a desired CMP result to provide feedback information to the first neural network. The feedback information is used by the first neural network to adjust the CMP control parameters in order to minimize a difference between the CMP result generated by the second neural network and the desired CMP result.

Additionally, the method includes an operation 1107 in which operations 1101–1105 are repeated. Operation 1107 allows the first neural network and the second neural network to be used as a control system from one CMP operation to another CMP operation.

A number of experiments have been performed to demonstrate the effectiveness of the feedforward neural network and the neural network controller. In the experiments, thermal oxide wafers were polished using SS12 slurry in a linear CMP operation. CMP parameters other than the air bearing pressures and the platen height, which vary between CMP operations, are shown in Table 1.

TABLE 1

CMP Parameters Other than Air Bearing Pressures and Platen Height

| Slurry Rate | Head (i.e., Wafer Carrier) Pressure | Belt (i.e., Polishing Pad) Speed | Head Speed | Belt Conditioning |
|---|---|---|---|---|
| 250 mL/min | 5 psi | 350 ft/min | 25 rpm | Linear/50%/ 6 psi/ 7 sec per sweep |

The CMP parameters in Table 1 have little impact on the wafer uniformity profile resulting from the CMP operation. Therefore, the CMP parameters in Table 1 were maintained as the air bearing pressures and platen height were changed between CMP operations. The number of experiments included a total of 32 CMP operations. Table 2 shows a few examples of the 32 CMP operations. For each CMP operation, the uniformity profile was characterized in terms of material removal rate (Å/min) measured at 67 different radii extending from 0 mm (i.e., wafer center) to 99 mm across the wafer. For radii between 0 mm to 70 mm, one measurement was made every 5 mm. For radii between 70 mm to 90 mm, one measurement was made every 2 mm. For radii between 90 mm to 100 mm, one measurement was made every 1 mm. Since the wafer carrier is rotating and the polishing pad is moving linearly, it can be established that the cross-diameter removal rate is symmetric with respect to the wafer center.

TABLE 2

Measured Material Removal Rates (Å/min)

| Run | | | | | | Radius (mm) | | | | |
|---|---|---|---|---|---|---|---|---|---|---|
| # | $P_b$ | $P_c$ | $P_d$ | $P_e$ | PH | 99 | 98 | . . . | 5 | 0 |
| 1 | 8 | 35 | 40 | 22 | 30 | 1846 | 2489 | . . . | 3935 | 3841 |
| 2 | 0 | 25 | 50 | 15 | 20 | 3273 | 3439 | . . . | 3748 | 3973 |
| . . . | . . . | . . . | . . . | . . . | . . . | . . . | . . . | . . . | . . . | . . . |
| 31 | 22 | 15 | 60 | 8 | 30 | 3956 | 4115 | . . . | 3702 | 3986 |
| 32 | 15 | 25 | 50 | 15 | 20 | 3314 | 3581 | . . . | 3832 | 4015 |

A training data set for the feedforward neural network was created by randomly selecting 16 CMP operations from the 32 CMP operations shown in Table 2. The Levenberg-Marquardt algorithm was used, with the parameter $\lambda=0.9$, to train the feedforward neural network using the data from the 16 CMP operations. Once trained, the feedforward neural network was validated by estimating the material removal rates corresponding to the different combinations of air bearing pressures and platen heights associated with the 16 CMP operations not used in training.

Also, the material removal rate estimates provided by the feedforward neural network were compared to corresponding material removal rate estimates obtained from a conventional response surface method (RSM). However, the conventional RSM method used all 32 CMP operations to establish a relationship between the air bearing pressures, platen height, and material removal rate. The conventional RSM method incorporated a linear regression model as shown in Equation 13.

$$RR(r_i)=A(r_i)P_b+B(r_i)P_c+C(r_i)P_d+D(r_i)P_e+E(r_i)PH+F(r_i), i=1, \ldots, 34 \quad \text{Equation 13:}$$

With respect to Equation 13, $RR_{RSM}(r_i)$ is the estimated material removal rate at radius $r_i$ obtained from the RSM method. The coefficient terms for the air bearing pressures $P_b$, $P_c$, $P_d$, $P_e$, and platen height PH are represented as $A(r_i)$, $B(r_i)$, $C(r_i)$, $D(r_i)$, and $E(r_i)$, respectively. The constant term is represented as $F(r_i)$.

Figure 12A:
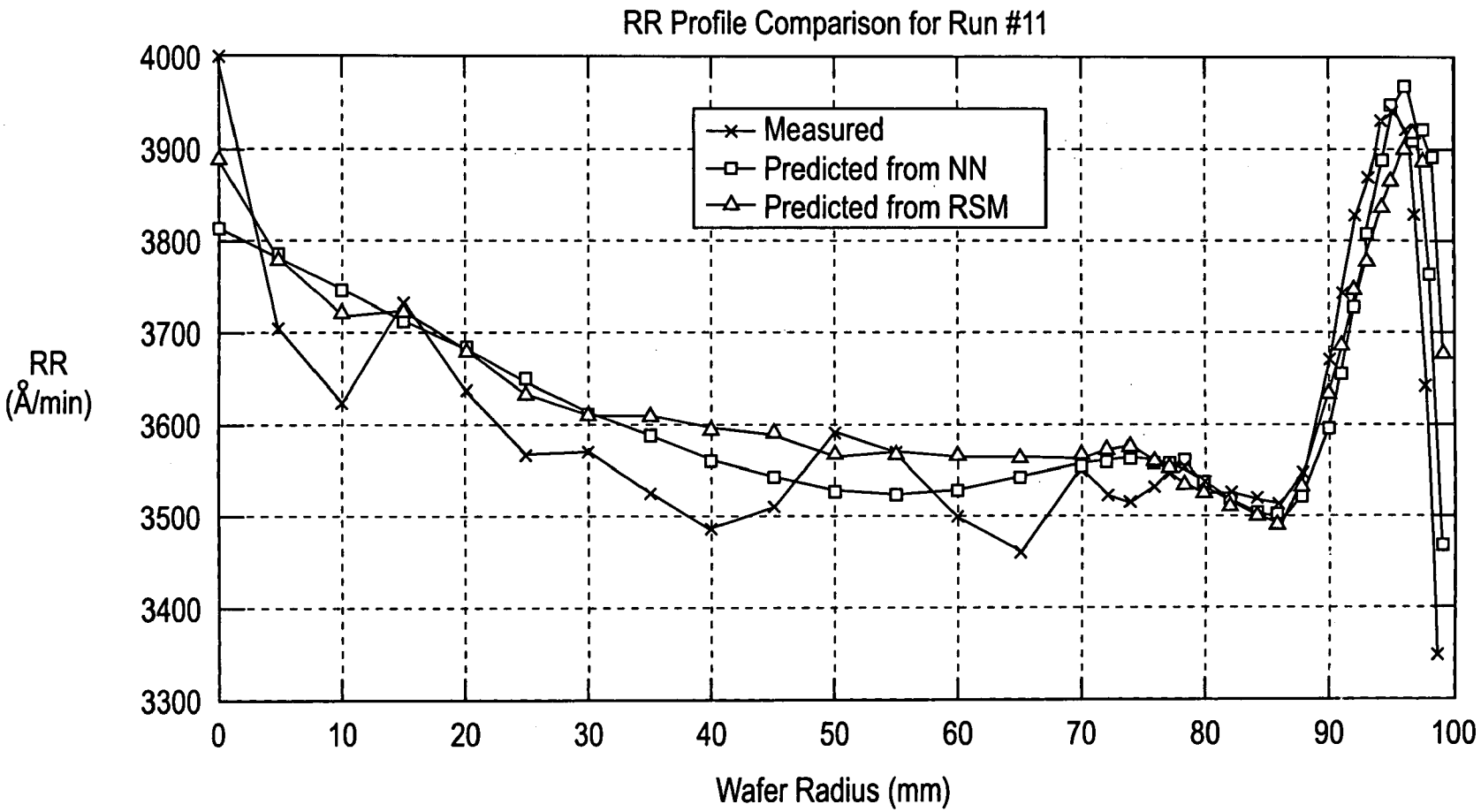
FIG. 12A is an illustration showing the estimated material removal rates obtained from the feedforward neural network and the RSM method for one of the non-training CMP operations (i.e., Run #11), in accordance with one embodiment of the present invention.
Figure 12B:
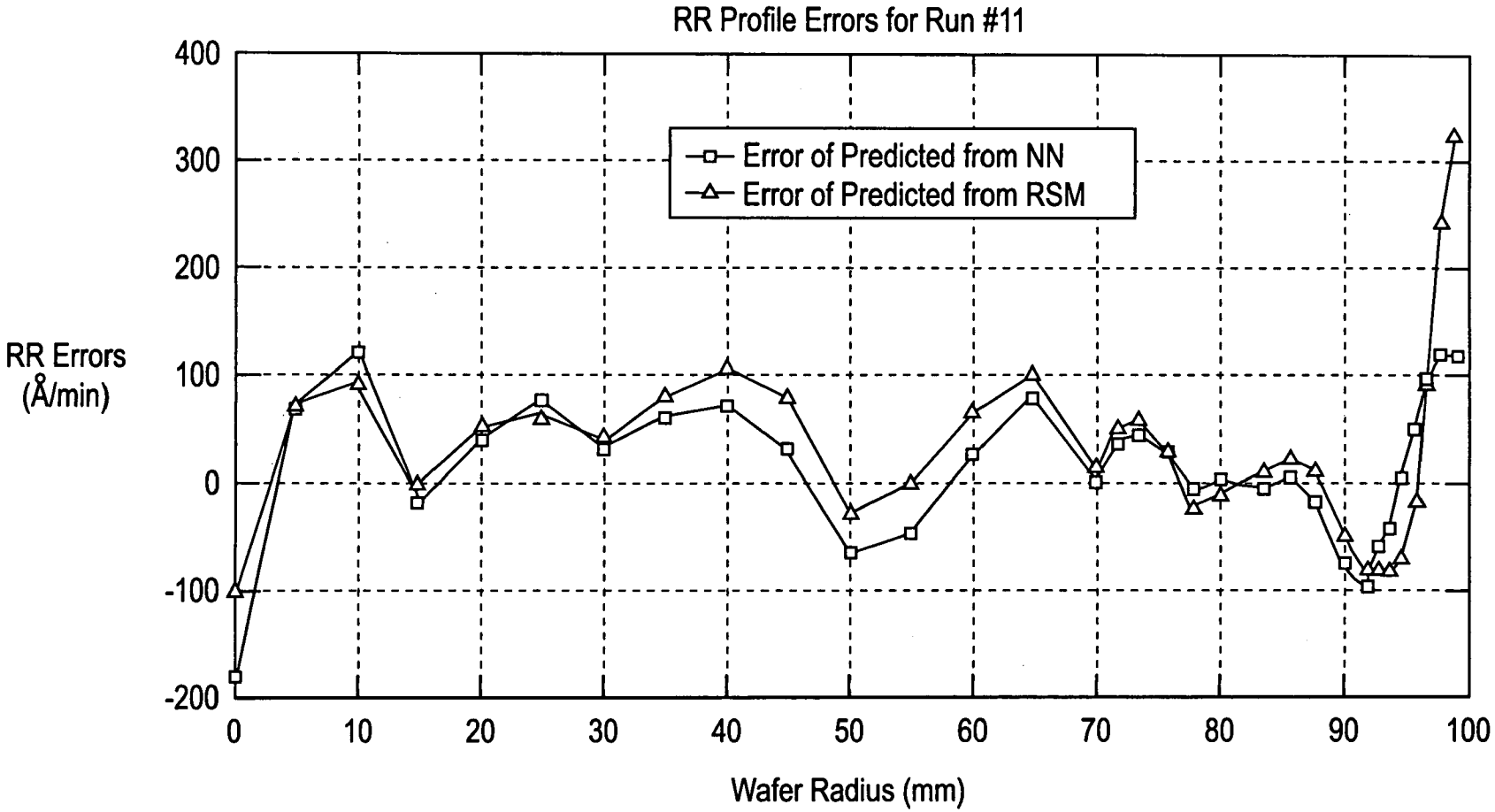
FIG. 12B is an illustration showing the errors of the feedforward neural network and the RSM method for Run #11, in accordance with one embodiment of the present invention.

FIG. 12A is an illustration showing the estimated material removal rates obtained from the feedforward neural network and the RSM method for one of the non-training CMP operations (i.e., Run #11), in accordance with one embodiment of the present invention. FIG. 12B is an illustration showing the errors of the feedforward neural network and the RSM method for Run #11, in accordance with one embodiment of the present invention. The air bearing pressures for Run #11 were $P_b$=15 psi, $P_c$=25 psi, $P_d$=50 psi, and $P_e$=15 psi. The platen height for Run #11 was PH=20 mil. As shown in FIGS. 12A and 12B, the material removal rate estimate provided by the feedforward neural network compares favorably to the measured material removal rate. A comparison of the feedforward neural network estimates and the RSM method estimates for Run #11 are shown in Table 3.

TABLE 3

Comparison of Feedforward Neural Network and RSM Estimates for Run #11

| Result | Feedforward Neural Network | RSM | Experiment |
|---|---|---|---|
| Maximum Error $\epsilon_{max}$ (Å/min) | 183 | 327 | — |
| Mean Square Error $\sigma$ (Å/min) | 69 | 89 | — |
| WIWNU | 3.69% | 3.52% | 4.45% |
| k-value | 6.15% | 5.57% | 8.90% |

With regard to Table 3, the Maximum Error $\epsilon_{max}$ and Mean Square Error $\sigma$ were calculated with respect to the desired CMP result $RR_{ref}(r_i)$ as shown in Equations 14 and 15, respectively. The within-wafer-non-uniformity (WIWNU) and the k-value were calculated as shown in Equations 16 and 17, respectively. Both the WIWNU and the k-value are used to qualify the material removal rate profile non-uniformity. For most cases, the WIWNU and the k-value should follow the same trend. However, the k-value is generally large than WIWNU. The k-value is calculated using the difference between the maximum and minimum values of the measurements. The WIWNU is calculated using the standard deviation of the measurements. Therefore, if one measurement point is an outlier, it is more likely that the k-value rather than the WIWNU will provide an indication of the outlier.

Equation 14:

$$\varepsilon_{\max} = \max_{1\le i\le 34} (|\overline{RR}(r_i) - RR_{ref}(r_i)|)$$

Equation 15:

$$\sigma = \sqrt{\frac{\sum_{i=1}^{34} (\overline{RR}(r_i) - RR_{ref}(r_i))^2}{34-1}}$$

Equation 16:

$$WIWNU = \frac{\sigma(\overline{RR}(r_i))}{\overline{RR}(r_i)_{mean}} \times 100\%$$

Equation 17:

$$k-\text{value} = \frac{\max_i(\overline{RR}(r_i)) - \min_i(\overline{RR}(r_i))}{2(\overline{RR}(r_i)_{mean})} \times 100\%$$

The feedforward neural network validation experiments previously described were all performed using the CMP parameters (other than air bearing pressures and platen height) shown in Table 1. In order to validate the efficiency of the feedforward neural network for different CMP parameters, the feedforward neural network as trained in the previously described experiments was used to estimate the material removal rate of an additional CMP operation having CMP parameters other than those shown in Table 1. The CMP parameters for the additional CMP operation are shown in Table 4. The air bearing pressures for the additional CMP operation were $P_b$=15 psi, $P_c$=50 psi, $P_d$=5 psi, and $P_e$=10 psi. The platen height for the additional CMP operation was PH=12 mil.

TABLE 4

CMP Parameters for Additional CMP Operation

| Slurry Rate | Head (i.e., Wafer Carrier) Pressure | Belt (i.e., Polishing Pad) Speed | Head Speed | Belt Conditioning |
|---|---|---|---|---|
| 200 mL/min | 5 psi | 225 ft/min | 20 rpm | Linear/100%/ 5 psi/ 7 sec per sweep |

Figure 13:
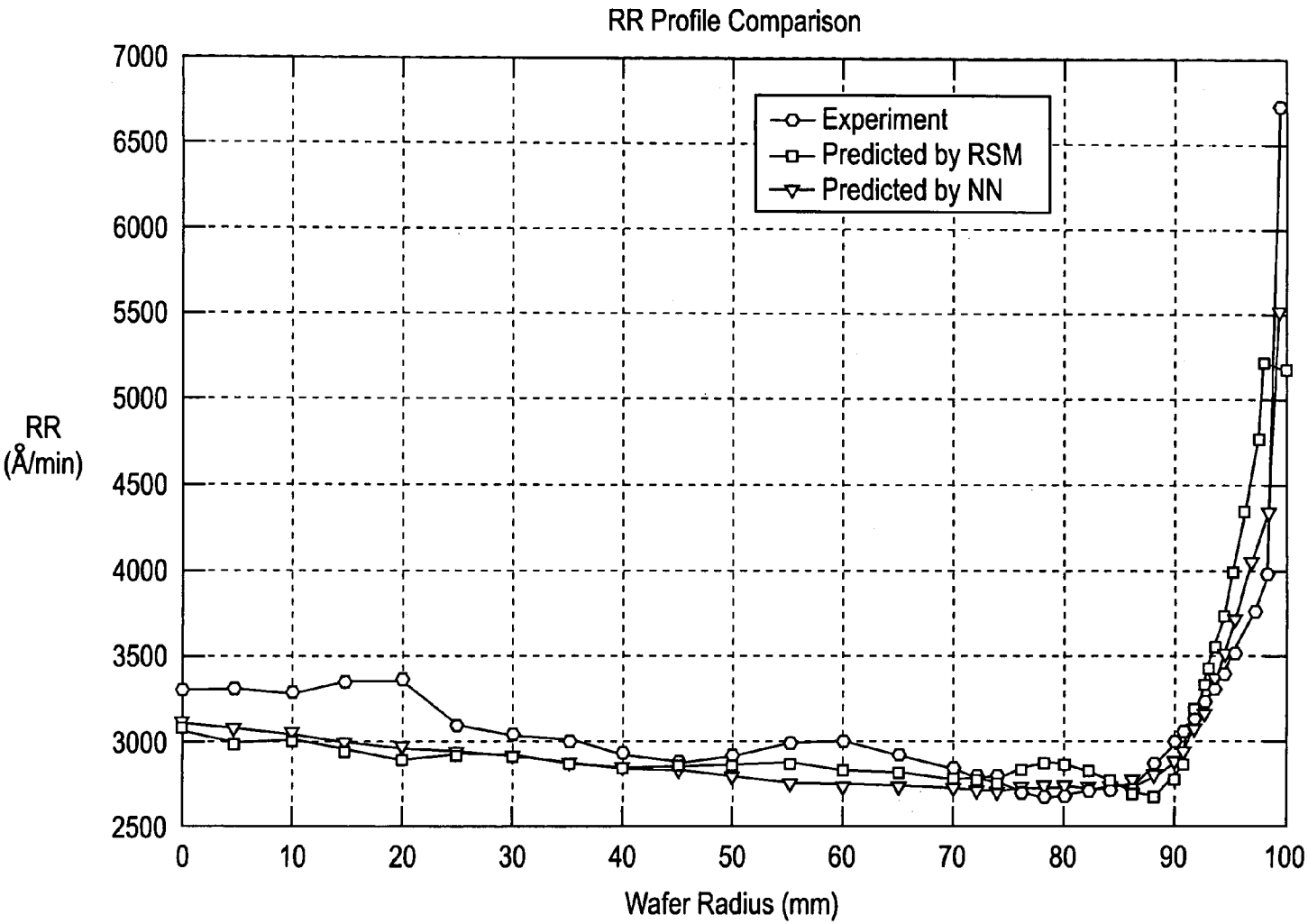
FIG. 13 is an illustration showing the estimated material removal rates obtained from the feedforward neural network and the RSM method for the additional CMP operations, in accordance with one embodiment of the present invention.

FIG. 13 is an illustration showing the estimated material removal rates obtained from the feedforward neural network and the RSM method for the additional CMP operations, in accordance with one embodiment of the present invention. A comparison of the feedforward neural network estimates and the RSM method estimates for the additional CMP operation are shown in Table 5. The data in FIG. 13 and Table 5 validate the efficiency of the feedforward neural network for estimating material removal rates under different CMP parameters.

TABLE 5

Comparison of Feedforward Neural Network and RSM Estimates for the Additional CMP Operation

| Result | Feedforward Neural Network | RSM |
|---|---|---|
| Maximum Error $\epsilon_{max}$ (Å/min) | 377 | 1000 |
| Mean Square Error $\sigma$ (Å/min) | 153 | 294 |

The experiments for validating the feedforward neural network, as previously discussed, demonstrate that the feedforward neural network provided a better estimate of the material removal rate than the conventional RSM method. Another important aspect of the feedforward neural network is that its weights can be quickly updated between each CMP operation. Therefore, the feedforward neural network can be implemented in real-time to compensate for CMP process parameter variations such as material removal rate drift.

Once the feedforward neural network is developed, the neural network controller can be trained off-line. Once trained, the neural network controller can be used to optimize (i.e., tune) the CMP control parameters for each CMP operation. Experiments were also performed to validate the neural network controller. The estimated material removal rates provided by the feedforward neural network, for each of the 16 CMP operations used in training the feedforward neural network, were used as feedback during training of the neural network controller. The CMP control parameters provided by the neural network controller were compared to corresponding CMP control parameters derived from the RSM method. The CMP control parameters were derived from the RSM method by minimizing an estimated non-uniformity error with respect to the desired CMP result as shown in Equation 18. The $\sigma$ term in Equation 18 represents the standard deviation of the error of the estimated material removal rate at each of the measurement points.

Equation 18:

$$u_{opt\text{-}RSM} = \arg\min_{u}\{\sigma[\overline{RR}_{RSM}(r_i) - RR_{ref}(r_i)]\} = [0 \text{ psi } 45 \text{ psi } 50 \text{ psi } 14 \text{ psi } 9 \text{ mil}]^T$$

Experiments demonstrated that the CMP process performance using the $u_{opt\text{-}RSM}$ CMP control parameters was not satisfactory. Therefore, an optimized set of CMP control parameters $u_{real}$ was empirically developed by tuning the CMP process around $u_{opt\text{-}RSM}$. The $u_{real}$ CMP control parameters are shown in Equation 19.

$$u_{real}=[5 \text{ psi } 25 \text{ psi } 50 \text{ psi } 15 \text{ psi } 20 \text{ mil}]^T \quad \text{Equation 19:}$$

For the neural network controller, the CMP control parameters were determined using the adaptation of neural network weights as previously described with respect to Equation 12. The set of CMP control parameters developed with the neural network controller is shown in Equation 20.

$$u_{opt\text{-}NN}=[0 \text{ psi } 30.5 \text{ psi } 47.2 \text{ psi } 14.1 \text{ psi } 19.2 \text{ mil}]^T \quad \text{Equation 20:}$$

Figure 14A:
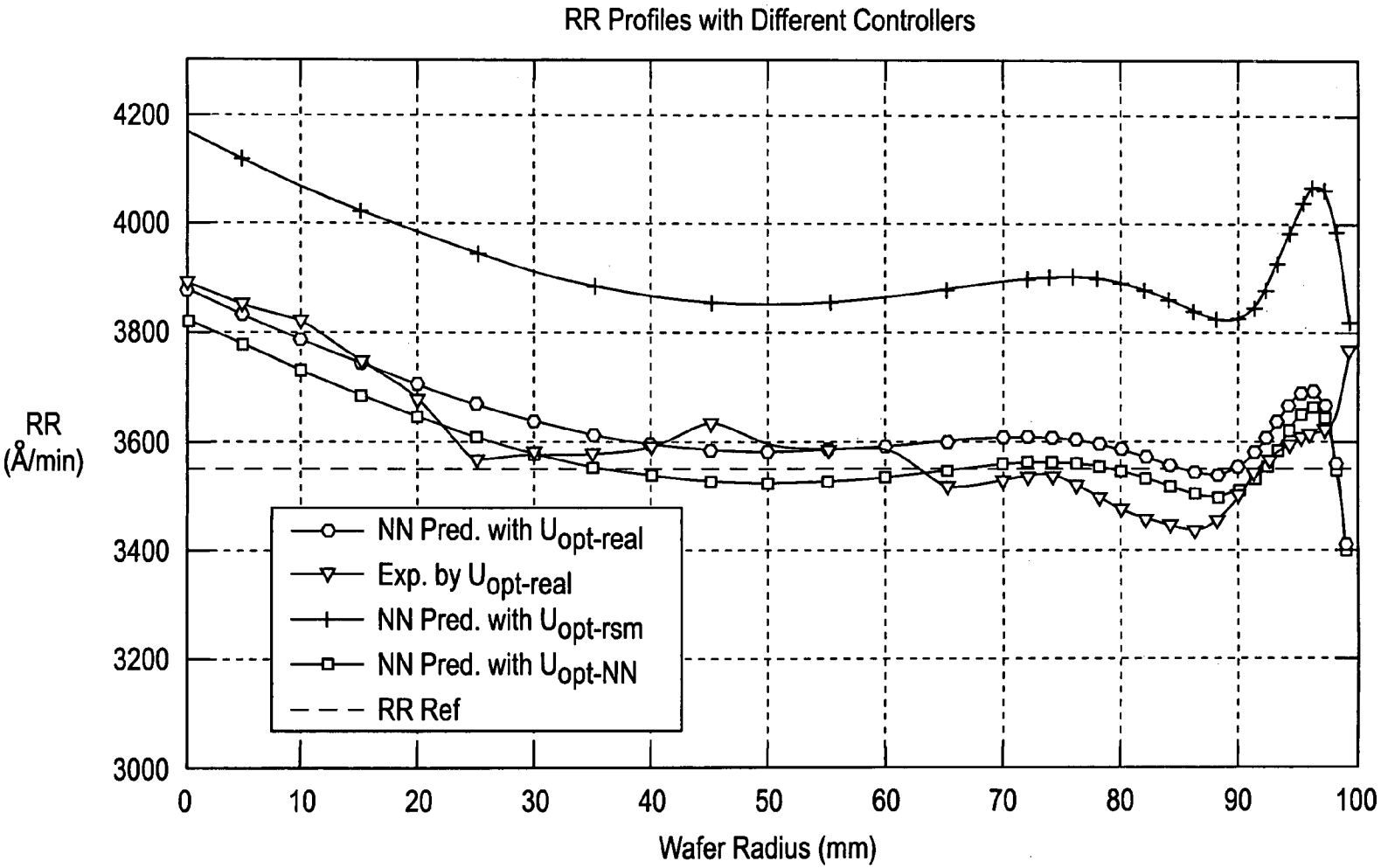
FIG. 14A is an illustration showing the estimated material removal rates obtained using $u_{opt\text{-}real}$, $u_{opt\text{-}RSM}$, and $u_{opt\text{-}NN}$, in accordance with one embodiment of the present invention.

FIG. 14A is an illustration showing the estimated material removal rates obtained using $u_{opt\text{-}real}$, $u_{opt\text{-}RSM}$, and $u_{opt\text{-}NN}$, in accordance with one embodiment of the present invention. More specifically, FIG. 14A shows the desired material removal rates (RR ref) the actual material removal rates obtained using $u_{opt\text{-}real}$ (Exp. by $u_{opt\text{-}real}$), and the feedforward neural network estimated material removal rates using each of $u_{opt\text{-}real}$, $u_{opt\text{-}RSM}$, and $u_{opt\text{-}NN}$ (NN pred. with $u_{opt\text{-}real}$, NN pred. with $u_{opt\text{-}RSM}$, NN pred. with $u_{opt\text{-}NN}$, respectively). The feedforward neural network estimated material removal rates using $u_{opt\text{-}real}$ is close to the desired material removal rates and fits well with the actual material removal rates. The difference between the feedforward neural network estimated material removal rates using $u_{opt\text{-}RSM}$ and $u_{opt\text{-}NN}$ demonstrate that the neural network controller provides a more favorable estimate of the CMP control parameters necessary to obtain the desired material removal rates.

Figure 14B:
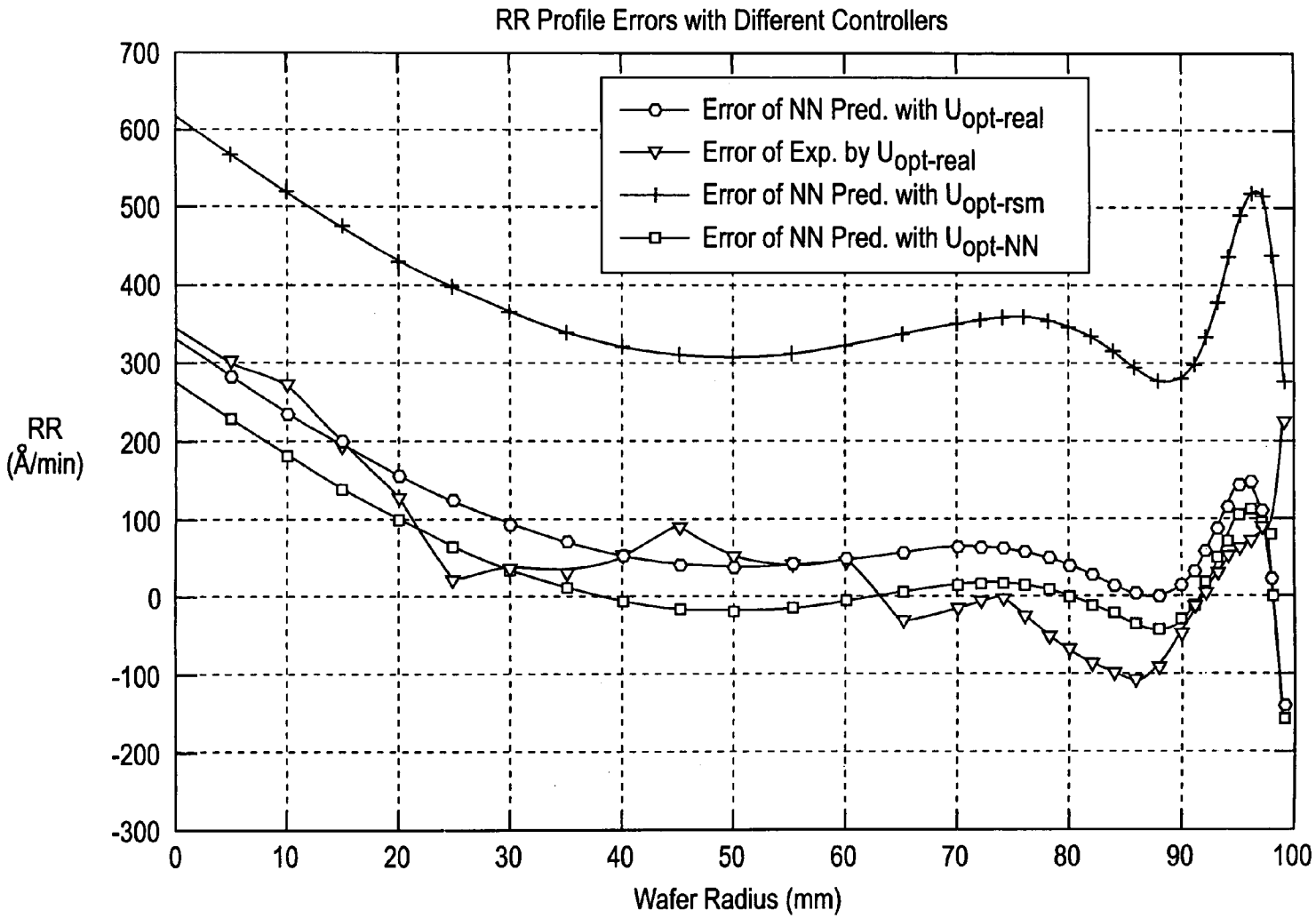
FIG. 14B is an illustration showing the material removal rate errors obtained using $u_{opt\text{-}real}$, $u_{opt\text{-}RSM}$, and $u_{opt\text{-}NN}$, in accordance with one embodiment of the present invention.

FIG. 14B is an illustration showing the material removal rate errors obtained using $u_{opt\text{-}real}$, $u_{opt\text{-}RSM}$, and $u_{opt\text{-}NN}$, in accordance with one embodiment of the present invention. More specifically, FIG. 14B shows the differences between the desired material removal rates (RR ref from FIG. 14A) the actual material removal rates obtained using $u_{opt\text{-}real}$ (Exp. by $u_{opt\text{-}real}$), and the feedforward neural network estimated material removal rates using each of $u_{opt\text{-}real}$, $u_{opt\text{-}RSM}$, and $u_{opt\text{-}NN}$ (NN pred. with $u_{opt\text{-}real}$, NN pred. with $u_{opt\text{-}RSM}$, NN pred. with $u_{opt\text{-}NN}$, respectively). A comparison of the feedforward neural network estimated material removal rates using each of $u_{opt\text{-}real}$, $u_{opt\text{-}RSM}$, and $u_{opt\text{-}NN}$ is shown in Table 6. The Maximum Error and Mean Square Error results shown in Table 6 demonstrate that the neural network controller is capable of estimating CMP control parameters that most favorably compare with the desired material removal rates.

TABLE 6

Comparison of Feedforward Neural Network Material Removal Rate Estimates Using Each of $u_{opt\text{-}real}$, $u_{opt\text{-}RSM}$, and $u_{opt\text{-}NN}$.

| Result | $u_{opt\text{-}RSM}$ | $u_{opt\text{-}NN}$ | $u_{opt\text{-}real}$ |
|---|---|---|---|
| Maximum Error $\epsilon_{max}$ (Å/min) | 622 | 204 | 349 |

TABLE 6-continued

Comparison of Feedforward Neural Network Material Removal Rate Estimates Using Each of $u_{opt-real}$, $u_{opt-RSM}$, and $u_{opt-NN}$

| Result | $u_{opt-RSM}$ | $u_{opt-NN}$ | $u_{opt-real}$ |
|---|---|---|---|
| Mean Square Error σ (Å/min) | 91 | 86 | 113 |
| WIWNU | 2.32% | 2.44% | 3.16% |
| k-value | 4.42% | 4.73% | 6.45% |

A simulation was performed to demonstrate the capability of the feedforward neural network and neural network controller to control a CMP process from one CMP operation to another CMP operation. The simulation included 500 CMP operations performed on oxide wafers. It was assumed that metrology data was available for every $5^{th}$ CMP operation in the simulation. Material removal rate drifts and random metrology disturbances were added to simulate realistic CMP processes. More specifically, an edge slow drift was added at every $5^{th}$ CMP operation, and a 2% metrology noise was added at each measurement point. The CMP control parameters estimated by the RSM method ($u_{opt-RSM}$) were used as the baseline CMP control parameters in the simulation. The feedforward neural network was used to simulate each CMP operation. The simulation without run-to-run (i.e., CMP operation-to-CMP operation) control was performed using the feedforward neural network and the $u_{opt-RSM}$ CMP control parameters. After each CMP operation, the feedforward neural network used without run-to-run control was updated using the material removal rate measurements (with drifts and disturbances added) and the CMP control parameters $u_{opt-RSM}$. The simulation with run-to-run control was performed using the feedforward neural network and the neural network controller. The neural network controller was used to provided an updated set of CMP control parameters $u_{opt-NN}$ to the feedforward neural network after each CMP operation.

Figure 15A:
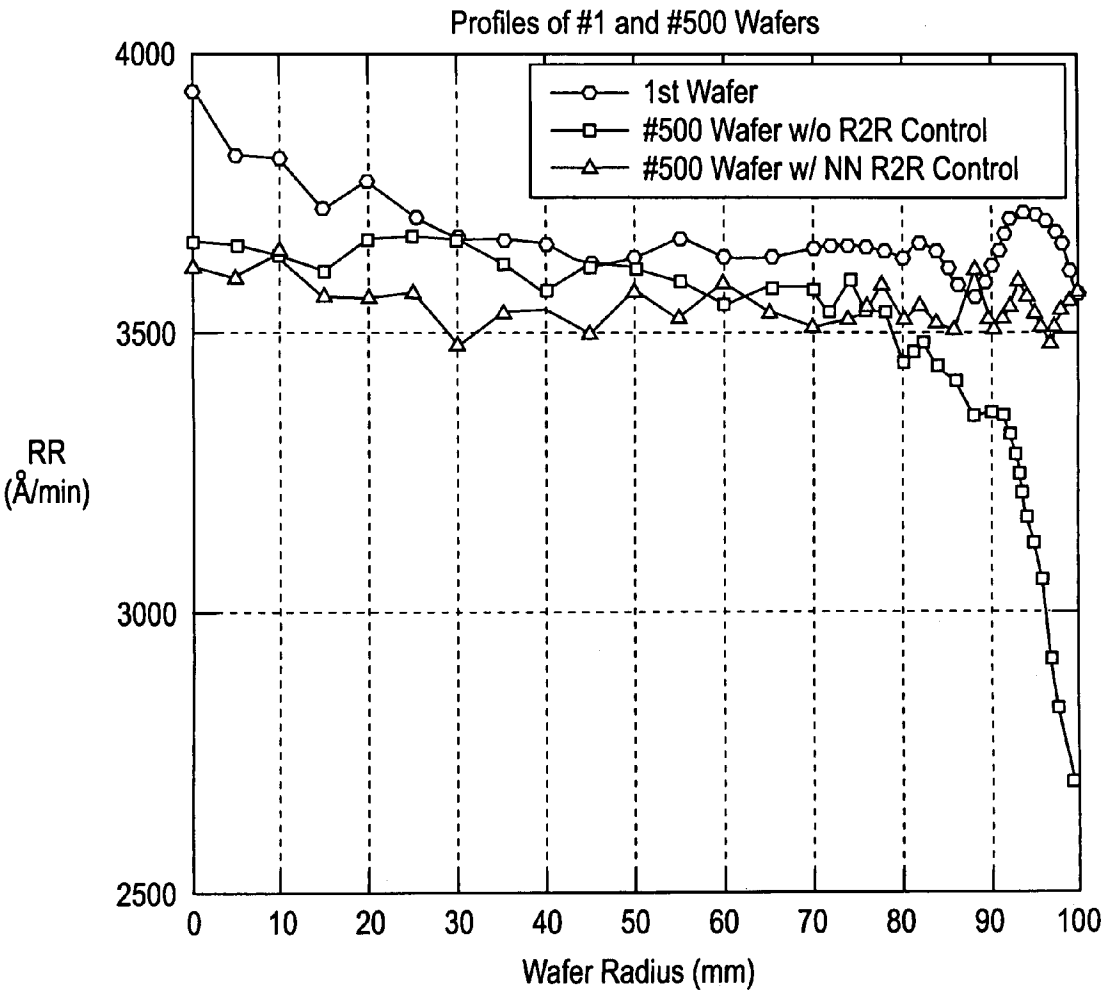
FIG. 15A is an illustration showing material removal rate profiles for the $1^{st}$ and $500^{th}$ CMP operation in the simulation, in accordance with one embodiment of the present invention.

FIG. 15A is an illustration showing material removal rate profiles for the $1^{st}$ and $500^{th}$ CMP operation in the simulation, in accordance with one embodiment of the present invention. The estimated material removal rate profiles for the $1^{st}$ CMP operation using the initial $u_{opt-RSM}$ CMP control parameters and the feedforward neural network are shown. The estimated material removal rate profiles for the $500^{th}$ CMP operation using the feedforward neural network without run-to-run control are shown as "#500 wafer w/o R2R control." The estimated material removal rate profiles for the $500^{th}$ CMP operation using the feedforward neural network with run-to-run control are shown as "#500 wafer w/NN R2R control."

Figure 15B:
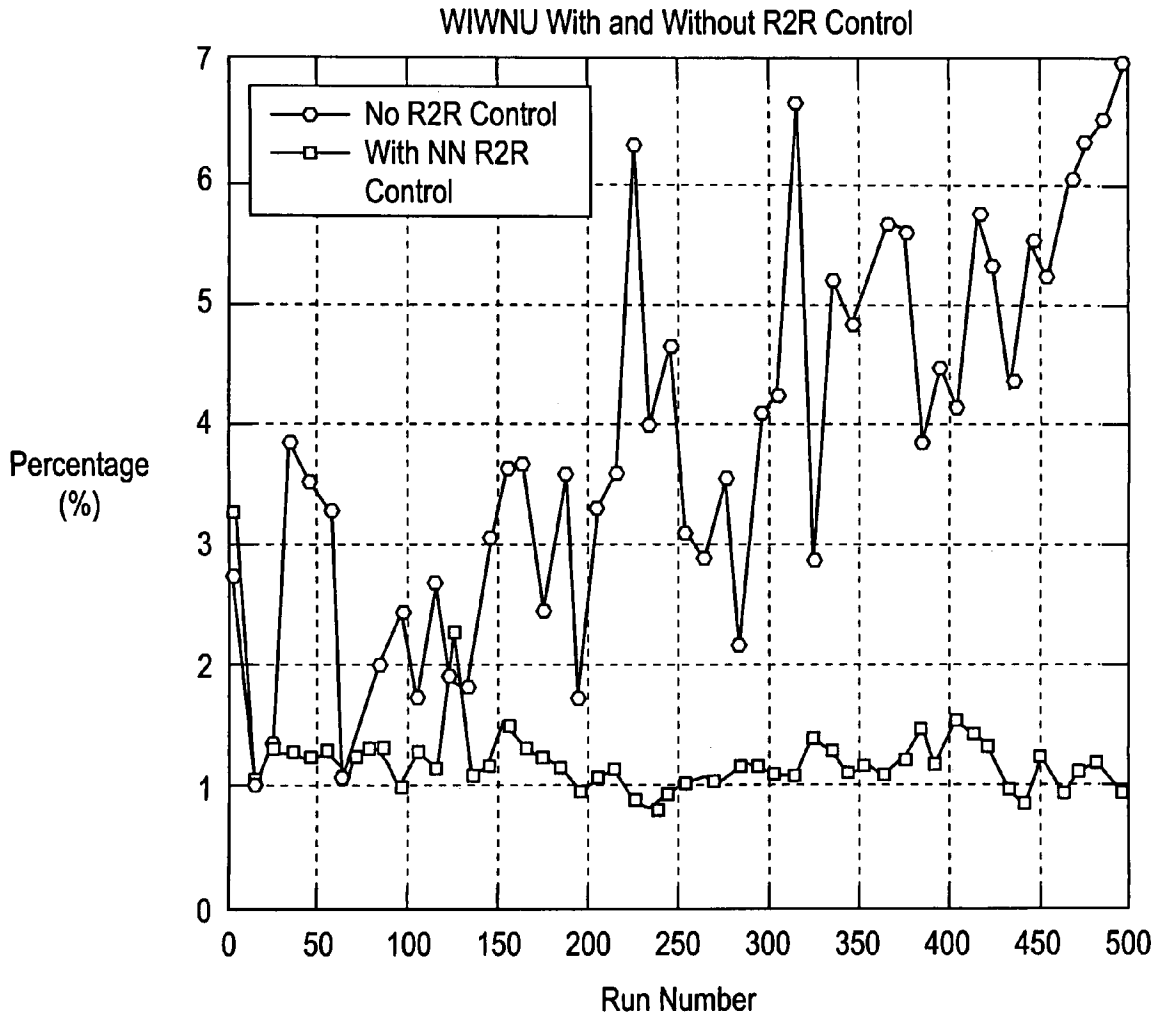
FIG. 15B is an illustration showing WIWNU values for the 500 CMP operation simulation, in accordance with one embodiment of the present invention.

FIG. 15B is an illustration showing WIWNU values for the 500 CMP operation simulation, in accordance with one embodiment of the present invention. The variation in WIWNU is shown for the simulation performed both with and without run-to-run control. Due to the drift introduced into the simulation, the WIWNU without run-to-run control increases significantly from 2–3% at the $1^{st}$ CMP operation to 6–7% at the $500^{th}$ CMP operation. The WIWNU with run-to-run control, however, maintains a stable level of 1–2% throughout the 500 CMP operation simulation.

Figure 15C:
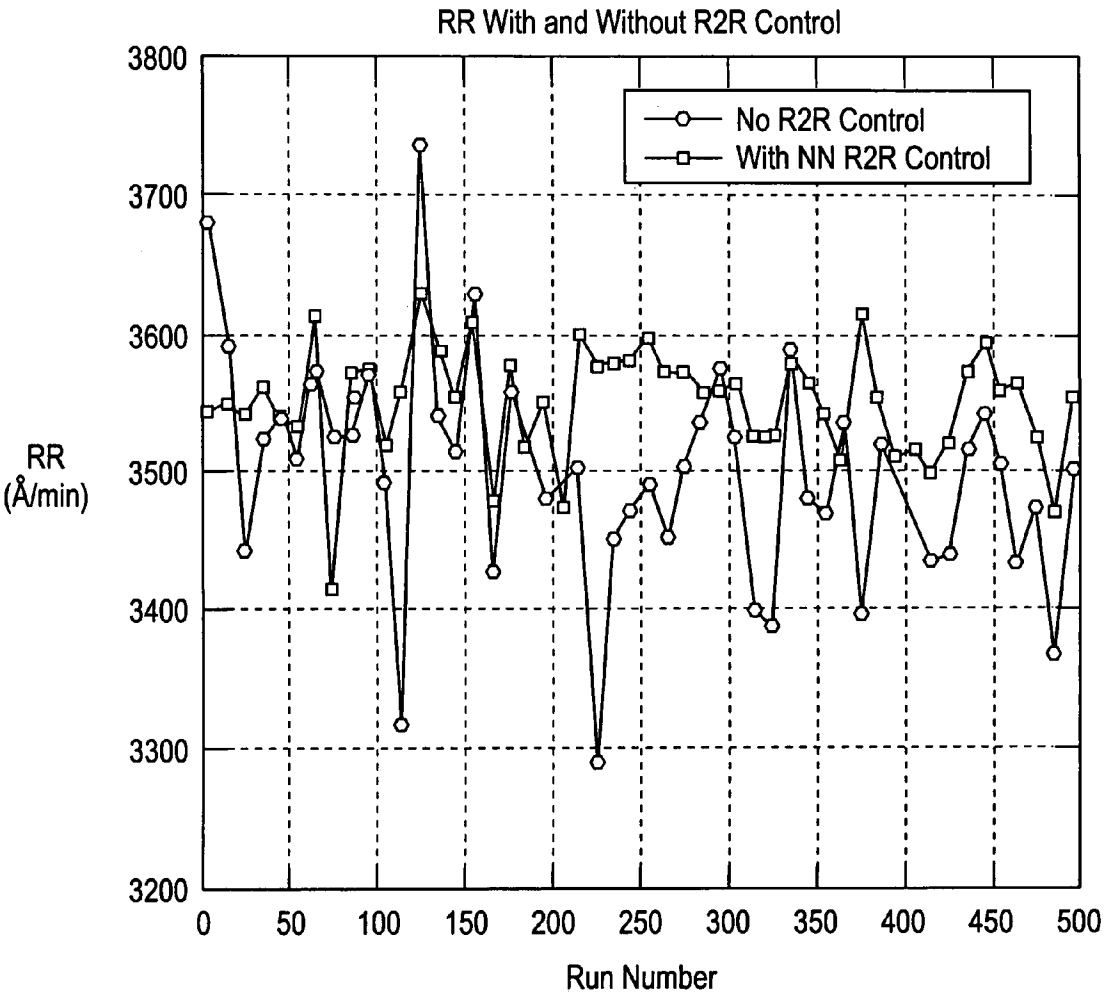
FIG. 15C is an illustration showing material removal rate variations during the 500 CMP operation simulation, in accordance with one embodiment of the present invention.

FIG. 15C is an illustration showing material removal rate variations during the 500 CMP operation simulation, in accordance with one embodiment of the present invention. The material removal rate with the run-to-run control is clearly stabilized around the desired material removal rate of 3550 Å/min. However, the material removal rate without the run-to-run control experiences a 100–200 Å/min drift.

Figure 15D:
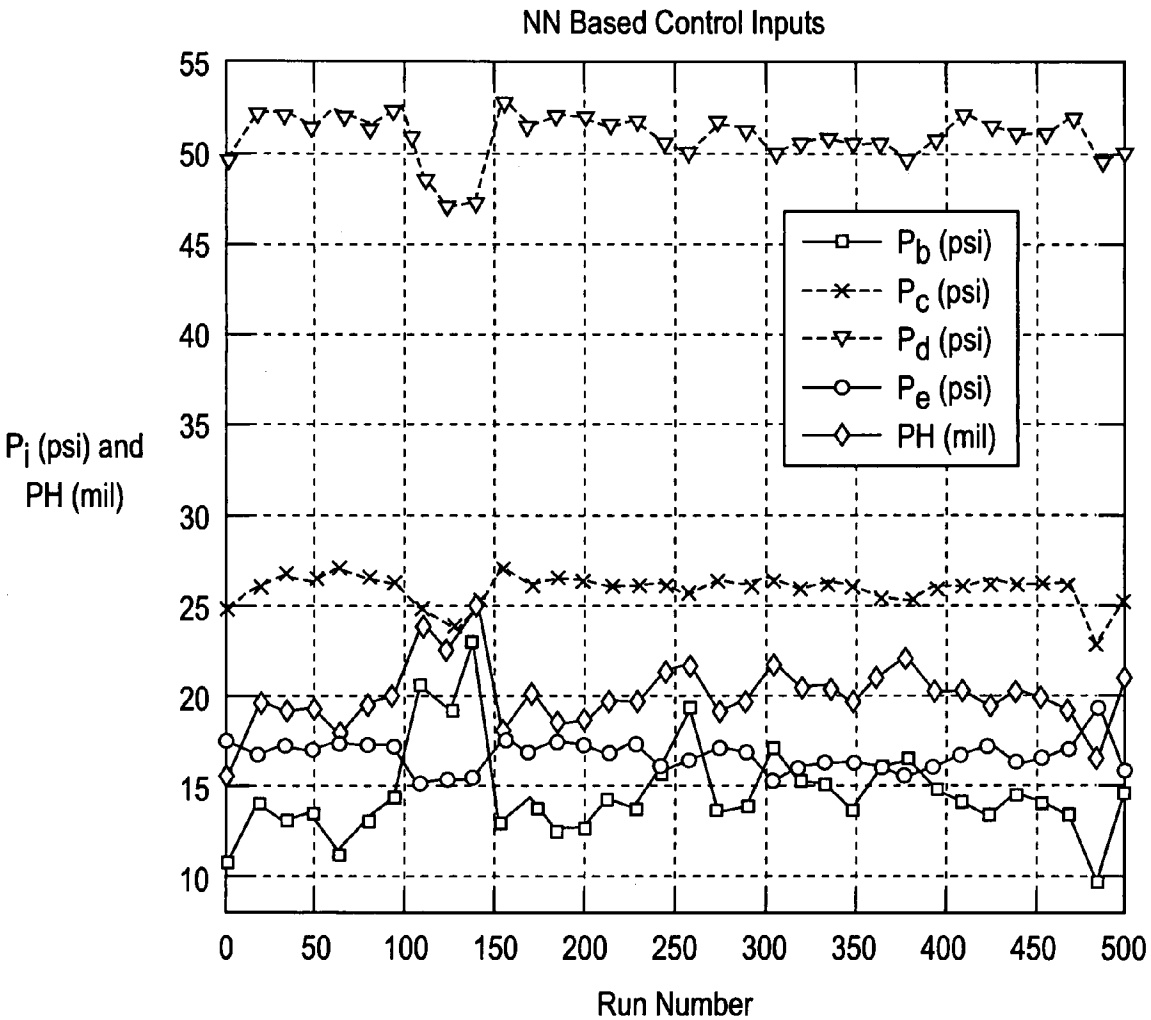
FIG. 15D is an illustration showing the CMP control parameters $u_{opt\text{-}NN}$ estimated by the neural network controller during the 500 CMP operation simulation, in accordance with one embodiment of the present invention.

FIG. 15D is an illustration showing the CMP control parameters $u_{opt-NN}$ estimated by the neural network controller during the 500 CMP operation simulation, in accordance with one embodiment of the present invention. The CMP control parameters $u_{opt-NN}$ estimated by the neural network controller include the air bearing pressures $P_b$, $P_c$, $P_d$, $P_e$, and the platen height PH. As demonstrated in FIG. 15D, the neural network controller tunes the CMP control parameters adaptively based on the estimated material removal rates obtained from the feedforward neural network. The 500 CMP operation simulation demonstrates that the neural network controller is capable of tuning the CMP control parameters to drive the CMP result toward the desired CMP result despite process drifts and disturbances.

Figure 16:
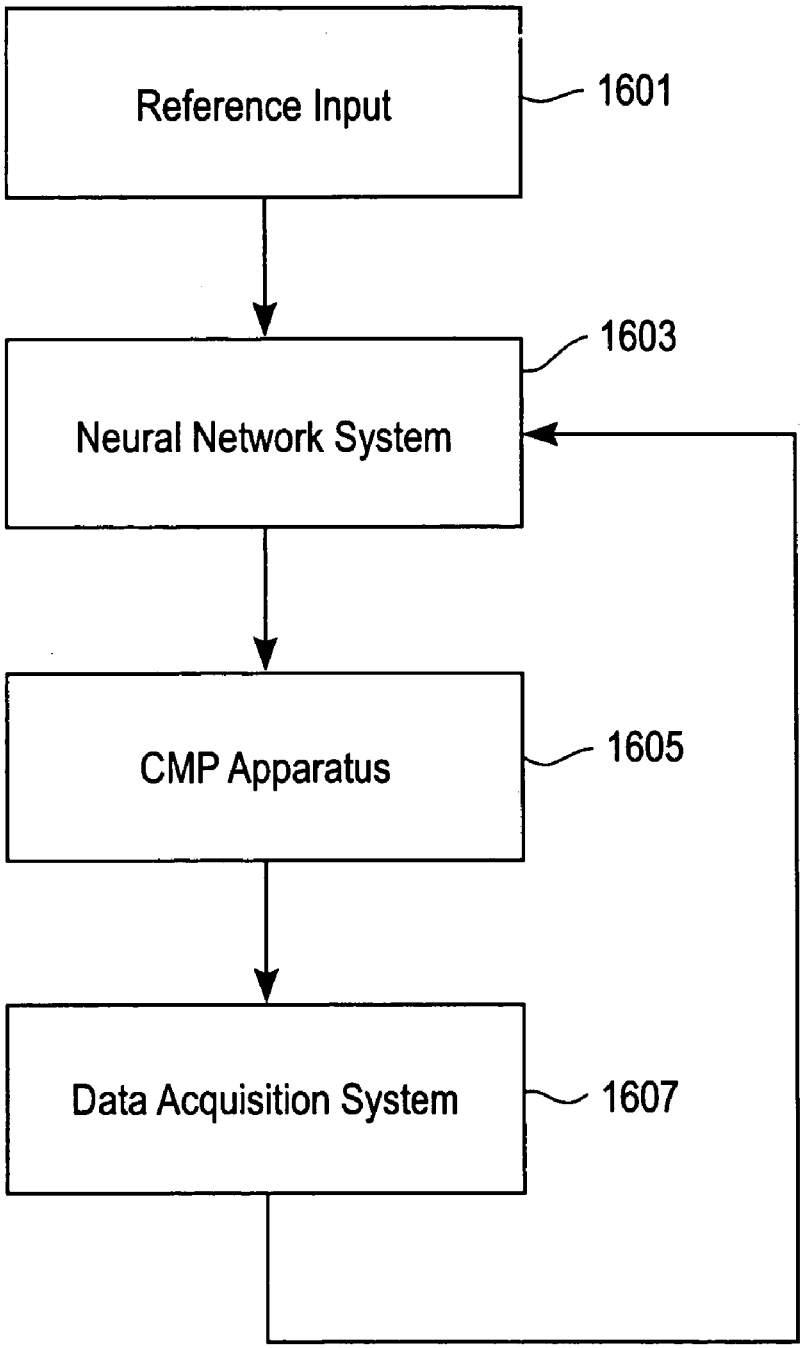
FIG. 16 is an illustration showing a CMP system, in accordance with one embodiment of the present invention.

FIG. 16 is an illustration showing a CMP system, in accordance with one embodiment of the present invention. The CMP system includes a CMP apparatus 1605 for performing a CMP operation. In one embodiment, the CMP apparatus is a linear-type CMP apparatus. In another embodiment, the CMP apparatus is a rotary-type CMP apparatus. The CMP system also includes a neural network system 1603. The neural network system 1603 is defined to implement a feedforward neural network and a neural network controller. In one embodiment, the feedforward neural network and neural network controller correspond to the feedforward neural network and neural network controller previously described herein. The neural network system 1603 generates control data to be supplied to the CMP apparatus 1605. The control data can then be used by the CMP apparatus 1605 to perform a subsequent CMP operation. In one embodiment, the control data includes an air bearing pressure, a platen height, or both the air bearing pressure and the platen height.

The CMP system also includes a data acquisition system 1607 for acquiring performance data associated with the CMP operation. In one embodiment, the performance data acquired by the data acquisition system 1607 is used by the neural network system 1603 to generate the control data to be supplied to the CMP apparatus 1605. In one embodiment, a reference input 1601 is provided to the neural network system 1603. The reference input 1601 is also used by the neural network system 1603 to generate the control data to be supplied to the CMP apparatus 1605. In one embodiment, both the performance data acquired by the data acquisition system 1607 and the reference input 1601 provided to the neural network system 1603 correspond to a desired CMP result. In one embodiment, the desired CMP result is a desired material removal rate profile.

The feedforward neural network and neural network controller have been described and demonstrated in terms of several exemplary embodiments. It should be understood, however, that the features and functionality of the feedforward neural network and the neural network controller of the present invention are not to be interpreted as being limited to the exemplary embodiments discussed herein. Both the feedforward neural network and neural network controller of the present invention can be tailored for and applied in many other CMP applications not specifically described herein.

With the above embodiments in mind, it should be understood that the invention may employ various computer-implemented operations involving data stored in computer systems. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing.

Any of the operations described herein that form part of the invention are useful machine operations. The invention also relates to a device or an apparatus for performing these operations. The apparatus may be specially constructed for the required purposes, or it may be a general-purpose computer selectively activated or configured by a computer program stored in the computer. In particular, various general-purpose machines may be used with computer programs written in accordance with the teachings herein, or it may be more convenient to construct a more specialized apparatus to perform the required operations.

The invention can also be embodied as computer readable code on a computer readable medium. The computer readable medium is any data storage device that can store data which can be thereafter be read by a computer system. Examples of the computer readable medium include hard drives, network attached storage (NAS), read-only memory, random-access memory, CD-ROMs, CD-Rs, CD-RWs, magnetic tapes, and other optical and non-optical data storage devices. The computer readable medium can also be distributed over a network coupled computer systems so that the computer readable code is stored and executed in a distributed fashion.

While this invention has been described in terms of several embodiments, it will be appreciated that those skilled in the art upon reading the preceding specifications and studying the drawings will realize various alterations, additions, permutations and equivalents thereof. It is therefore intended that the present invention includes all such alterations, additions, permutations, and equivalents as fall within the true spirit and scope of the invention.

What is claimed is:

1. A method for estimating a chemical mechanical planarization (CMP) result, comprising:

developing a neural network, wherein the neural network is configured to relate one or more CMP control parameters to a CMP result;

training the neural network using data for the one or more CMP control parameters and the CMP result; and using the neural network to estimate the CMP result of a subsequent CMP operation based on data to be applied in the subsequent CMP operation for the one or more CMP control parameters.

2. A method for estimating a CMP result as recited in claim 1, wherein the CMP result is obtained using a linear CMP apparatus.

3. A method for estimating a CMP result as recited in claim 2, wherein the one or more CMP control parameters include an air bearing pressure present between a platen and an underside of a polishing pad within a CMP system and a distance of the platen from the underside of the polishing pad, wherein the CMP result is a wafer uniformity profile.

4. A method for estimating a CMP result as recited in claim 1, wherein the neural network is a static neural network having an input layer, one hidden layer, and an output layer.

5. A method for estimating a CMP result as recited in claim 4, wherein the one hidden layer includes a number of hidden neurons and the output layer includes one output neuron, each of the number of hidden neurons having a hyperbolic tangent activation function, the output neuron being represented by a linear function.

6. A method for estimating a CMP result as recited in claim 1, further comprising:

selecting the data used for training the neural network from a design of experiments used to qualify a CMP apparatus used to produce the CMP result, wherein the data is selected to cover an anticipated range for the one or more CMP control parameters and the CMP result.

7. A method for estimating a CMP result as recited in claim 1, wherein the training of the neural network is based on an iterative minimization of an estimation error function performed using an adaptation of weights of the neural network, the adaptation of weights being based on a Levenberg-Marquardt algorithm.

8. A method for estimating a CMP result as recited in claim 1, further comprising:

performing the subsequent CMP operation using the data to be applied in the subsequent CMP operation for the one or more CMP control parameters;

updating weights of the neural network using the one or more CMP control parameters applied in the subsequent CMP operation and the CMP result of the subsequent CMP operation.

9. A method for adjusting control parameters of a chemical mechanical planarization (CMP) operation, comprising:

developing a neural network, wherein the neural network is configured to relate a comparison between a desired CMP result and an obtained CMP result to one or more CMP control parameters associated with the obtained CMP result;

training the neural network using data for the desired CMP result, the obtained CMP result, and the one or more CMP control parameters associated with the obtained CMP result; and using the neural network to determine values for one or more CMP control parameters to be used in a subsequent CMP operation such that the obtained CMP result for the subsequent CMP operation is acceptable relative to the desired CMP result, wherein the one or more CMP control parameters to be used in the subsequent CMP operation are the same as the one or more CMP control parameters associated with the obtained CMP result.

10. A method for adjusting control parameters of a CMP operation as recited in claim 9, wherein the CMP operation is a linear CMP operation.

11. A method for adjusting control parameters of a CMP operation as recited in claim 10, wherein the one or more CMP control parameters associated with the obtained CMP result include an air bearing pressure present between a platen and an underside of a polishing pad within a CMP system and a distance of the platen from the underside of the polishing pad, the obtained CMP result and the desired CMP result corresponding to a wafer uniformity profile.

12. A method for adjusting control parameters of a CMP operation as recited in claim 9, wherein the neural network is a static neural network having an input layer, one hidden layer, and an output layer.

13. A method for adjusting control parameters of a CMP operation as recited in claim 12, wherein the input layer includes the desired CMP result, the one hidden layer includes a number of hidden neurons, and the output layer includes an output for each of the one or more CMP control parameters.

14. A method for adjusting control parameters of a CMP operation as recited in claim 9, wherein the training of the neural network is performed using a recursive error back propagation method.

* * * * *